US008690557B2

(12) United States Patent
Tada

(10) Patent No.: US 8,690,557 B2
(45) Date of Patent: Apr. 8, 2014

(54) VARIABLE DISPLACEMENT VANE PUMP

(75) Inventor: Makoto Tada, Zama (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 586 days.

(21) Appl. No.: 12/948,272

(22) Filed: Nov. 17, 2010

(65) Prior Publication Data

US 2011/0150684 A1 Jun. 23, 2011

(30) Foreign Application Priority Data

Dec. 18, 2009 (JP) ..... 2009-287885

(51) Int. Cl.
*F01C 20/18* (2006.01)

(52) U.S. Cl.
USPC ..... 418/22; 418/30; 418/31; 417/212; 417/218

(58) Field of Classification Search
USPC ..... 418/26, 16, 22, 24, 27, 29–31; 417/218, 417/212
See application file for complete search history.

(56) References Cited

U.S. PATENT DOCUMENTS

2007/0280842 A1* 12/2007 Ueki et al. ..... 418/26
2008/0118372 A1* 5/2008 Hoshina et al. ..... 418/24
2009/0291008 A1* 11/2009 Uchida et al. ..... 418/30

FOREIGN PATENT DOCUMENTS

JP 2007-138876 A 6/2007

* cited by examiner

*Primary Examiner* — Mary A Davis
(74) *Attorney, Agent, or Firm* — Foley & Lardner LLP

(57) ABSTRACT

A variable displacement vane pump includes: a plate side high pressure introduction groove formed in the pressure plate or in the cam ring, formed so that an entire is positioned within a radial width of the cam ring, and a part is positioned in a circumferential region between the suction port and the discharge port, and arranged to receive a hydraulic pressure larger than a suction pressure; and a housing side high pressure introduction groove formed in the second housing or in the cam ring, formed so that an entire is positioned within the radial width of the cam ring, that a radial center is positioned radially outside the radial center of the plate side high pressure introduction groove, and that a part is overlapped with the plate side high pressure introduction groove in the circumferential direction, and arranged to receive the hydraulic pressure larger than the suction pressure.

18 Claims, 17 Drawing Sheets

VARIABLE DISPLACEMENT VANE PUMP

BACKGROUND OF THE INVENTION

This invention relates to a variable displacement vane pump arranged to supply a hydraulic fluid to a power steering apparatus and so on for a vehicle.

Japanese Patent Application Publication No. 2007-138876 discloses a conventional variable displacement vane pump employed to a power steering apparatus and so on for a vehicle. This variable displacement vane pump includes a first plate member (corresponding to a pressure plate) and a second plate member (corresponding to a second housing) disposed on both sides of a cam ring in an axial direction. Each of the first plate member and the second plate member has a confronting surface which confronts the cam ring, and which is formed with a high pressure introduction groove arranged to receive the discharge pressure in the discharge port. The discharge pressure is introduced through the high pressure introduction groove to a portion between the cam ring and each of the both plate members, so as to decrease a sliding resistance at an eccentric movement of the cam ring.

SUMMARY OF THE INVENTION

In the conventional variable displacement vane pump, on an inner side surface of the second housing corresponding to the second plate member, there are formed a discharge port, and back pressure grooves arranged to move vanes by receiving the discharge pressure in the discharge port. Moreover, the second housing is tightened with the first housing at the outer circumferential portion by the bolts. Accordingly, the second housing is deformed in a direction apart from the cam ring. By the deformation of the second housing, an axial clearance between the cam ring and the second housing on the inner circumferential side of the high pressure introduction groove becomes large. Therefore, the much pressure in the high pressure introduction groove is leaked to the inner circumferential side of the cam ring.

Moreover, the discharge pressure is acted to a wide area of the outer side surface (a surface opposite to the confronting surface confronting the cam ring) of the pressure plate corresponding to the first plate member, so that the pressure plate is pressed to the cam ring. Moreover, the outer circumferential portion of the pressure plate is supported by an adapter ring disposed radially outside the cam ring. The center portion of the pressure plate is deformed in a direction approaching the cam ring. Accordingly, the deformation of the pressure plate becomes larger toward the center of the pressure plate. By this deformation, an axial clearance between the cam ring and the pressure plate on the outer circumferential side of the high pressure introduction groove becomes large. Therefore, much pressure in the high pressure introduction groove is leaked to the outer circumference side of the cam ring.

It is, therefore, an object of the present invention to provide a variable displacement vane pump arranged to suppress a leakage of a hydraulic fluid even when the hydraulic fluid is introduced into a portion between a pressure plate or a second housing, and a cam ring.

According to one aspect of the present invention, a variable displacement vane pump comprises: a pump housing including a first housing which has a pump element receiving portion which is located radially inside the first housing, and which has an opening opened in a first axial end surface of the first housing, a second housing contacting the first housing, and closing the opening of the first axial end surface of the first housing, and a joining member joining an outer circumference portion of the first housing and an outer circumference portion of the second housing; a drive shaft rotatably supported within the pump housing; an adapter ring which is a substantially circular shape, and which is mounted in an inner circumference surface of the pump element receiving portion of the first housing; a cam ring disposed radially inside the adapter ring, and arranged to be moved to be eccentric from a center of the drive shaft; a rotor which is received radially inside the cam ring, which is driven by the drive shaft, and which includes a plurality of slits formed in an outer circumference portion of the rotor; a plurality of vanes each of which is received in one of the slits, each of which is arranged to be moved into and out of the one of the slits, and which separate a plurality of pump chambers radially between the cam ring and the rotor; a pressure plate disposed within the pump element receiving portion between an inner side surface of the pump element receiving portion and the adapter ring, and urged toward the adapter ring by a discharge pressure acted to a surface of the pressure plate which is opposite to a confronting surface confronting the adapter ring; a suction port formed in at least one of the second housing and the pressure plate, and opened in a region in which an internal volume of each of the pump chambers is increased in accordance with the rotation of the rotor; a suction passage formed within the pump housing, and arranged to introduce the hydraulic fluid through the suction port to the pump chambers positioned in the region in which the internal volume of each of the pump chambers is increased; a discharge port formed in at least one of the second housing and the pressure plate, and opened in a region in which the internal volume of each of the pump chambers is decreased in accordance with the rotation of the rotor; a discharge passage formed within the pump housing, and arranged to introduce, through the discharge port to the outside, the hydraulic fluid discharged from the pump chambers positioned in the region in which the internal volume of each of the pump chambers is decreased; a first fluid pressure chamber separated radially between the adapter ring and the cam ring, on a side on which an internal volume is decreased when the cam ring is moved in a direction in which an eccentric amount of the cam ring is increased; a second fluid pressure chamber separated radially between the adapter ring and the cam ring, on a side on which an internal volume is increased when the cam ring is moved in a direction in which the eccentric amount of the cam ring is increased; a control section configured to control an internal pressure of the first fluid pressure chamber or the second fluid pressure chamber, and thereby to control the eccentric amount of the cam ring; a plate side high pressure introduction groove formed in the confronting surface of the pressure plate which confronts the cam ring, or in a confronting surface of the cam ring which confronts the pressure plate, formed so that an entire of the plate side high pressure introduction groove is positioned within a radial region of a radial width of the cam ring, and that a part of the plate side high pressure introduction groove is positioned in a circumferential region between the suction port and the discharge port, and arranged to receive a hydraulic pressure larger than a suction pressure within the suction port; and a housing side high pressure introduction groove formed in a confronting surface of the second housing which confronts the cam ring, or in a confronting surface of the cam ring which confronts the second housing, formed so that an entire of the housing side high pressure introduction groove is positioned within the region of the radial width of the cam ring, that a radial center of the radial width of the housing side high pressure introduction groove is positioned radially outside the radial center of the radial width of the plate side high pressure introduction groove, and that a part of the housing side high pressure introduction groove is overlapped with the plate side high pressure introduction groove in the circumferential direction, and arranged to receive the hydraulic pressure larger than the suction pressure within the suction port.

According to another aspect of the invention, a variable displacement vane pump comprises: a pump housing including a first housing which has a pump element receiving portion which is located radially inside the first housing, and which has an opening opened in a first axial end surface of the first housing, a second housing contacting the first housing, and closing the opening of the first axial end surface of the first housing, and a joining member joining an outer circumference portion of the first housing and an outer circumference portion of the second housing; a drive shaft rotatably supported within the pump housing; an adapter ring which is a substantially circular shape, and which is mounted in an inner circumference surface of the pump element receiving portion of the first housing; a cam ring disposed radially inside the adapter ring, and arranged to be moved to be eccentric from a center of the drive shaft; a rotor which is received radially inside the cam ring, which is driven by the drive shaft, and which includes a plurality of slits formed in an outer circumference portion of the rotor; a plurality of vanes each of which is received in one of the slits, each of which is arranged to be moved into and out of the one of the slits, and which separate a plurality of pump chambers radially between the cam ring and the rotor; a pressure plate disposed within the pump element receiving portion between an inner side surface of the pump element receiving portion and the adapter ring, and urged toward the adapter ring by a discharge pressure acted to a surface of the pressure plate which is opposite to a confronting surface confronting the adapter ring; a suction port formed in at least one of the second housing and the pressure plate, and opened in a region in which an internal volume of each of the pump chambers is increased in accordance with the rotation of the rotor; a suction passage formed within the pump housing, and arranged to introduce the hydraulic fluid through the suction port to the pump chambers positioned in the region in which the internal volume of each of the pump chambers is increased; a discharge port formed in at least one of the second housing and the pressure plate, and opened in a region in which the internal volume of each of the pump chambers is decreased in accordance with the rotation of the rotor; a discharge passage formed within the pump housing, and arranged to introduce, through the discharge port to the outside, the hydraulic fluid discharged from the pump chambers positioned in the region in which the internal volume of each of the pump chambers is decreased; a first fluid pressure chamber separated radially between the adapter ring and the cam ring, on a side on which an internal volume is decreased when the cam ring is moved in a direction in which an eccentric amount of the cam ring is increased; a second fluid pressure chamber separated radially between the adapter ring and the cam ring, on a side on which an internal volume is increased when the cam ring is moved in a direction in which the eccentric amount of the cam ring is increased; a control section configured to control an internal pressure of the first fluid pressure chamber or the second fluid pressure chamber, and thereby to control the eccentric amount of the cam ring; a first fluid pressure chamber side high pressure introduction groove formed in the confronting surface of the pressure plate which confronts the cam ring, or in a confronting surface of the cam ring which confronts the pressure plate, positioned so that an entire of the first fluid pressure chamber side high pressure introduction groove is positioned within a radial region of a radial width of the cam ring, and that a part of the first fluid pressure chamber side high pressure introduction groove is positioned in a circumferential region between a rotational terminal end of the suction port which is a terminal end of the suction port in a rotational direction of the rotor, and a rotational start end of the discharge port which is a start end of the discharge port in the rotational direction of the rotor, and arranged to receive a hydraulic pressure larger than the suction pressure within the suction port; and a second fluid pressure chamber side high pressure introduction groove formed in the confronting surface of the pressure plate which confronts the cam ring, or in the confronting surface of the cam ring which confronts the pressure plate, formed so that an entire of the second fluid pressure chamber side high pressure introduction groove is positioned within the radial region of the radial width of the cam ring, that a radial center of a radial width of the second fluid pressure chamber side high pressure introduction groove is positioned at a position apart from a center of the cam ring with respect to a radial center of the radial width of the first fluid pressure chamber side high pressure introduction groove in a maximum eccentric state of the cam ring, and that a part of the second fluid pressure chamber side high pressure introduction groove is positioned in a circumferential region between a rotational terminal end of the discharge port which is a terminal end of the discharge port in the rotational direction of the rotor and a rotational start end of the suction port which is a start end of the suction portion the rotational direction of the rotor, and arranged to receive a hydraulic pressure larger than the suction pressure within the suction port.

According to still another aspect of the invention, a variable displacement vane pump comprises: a pump housing including a first housing which has a pump element receiving portion which is located radially inside the first housing, and which has an opening opened in a first axial end surface of the first housing, a second housing contacting the first housing, and closing the opening of the first axial end surface of the first housing, and a joining member joining an outer circumference portion of the first housing and an outer circumference portion of the second housing; a drive shaft rotatably supported within the pump housing; an adapter ring which is a substantially circular shape, and which is mounted in an inner circumference surface of the pump element receiving portion of the first housing; a cam ring disposed radially inside the adapter ring, and arranged to be moved to be eccentric from a center of the drive shaft; a rotor which is received radially inside the cam ring, which is driven by the drive shaft, and which includes a plurality of slits formed in an outer circumference portion of the rotor; a plurality of vanes each of which is received in one of the slits, each of which is arranged to be moved into and out of the one of the slits, and which separate a plurality of pump chambers radially between the cam ring and the rotor; a pressure plate disposed within the pump element receiving portion between an inner side surface of the pump element receiving portion and the adapter ring, and urged toward the adapter ring by a discharge pressure acted to a surface of the pressure plate which is opposite to a confronting surface confronting the adapter ring; a suction port formed in at least one of the second housing and the pressure plate, and opened in a region in which an internal volume of each of the pump chambers is increased in accordance with the rotation of the rotor; a suction passage formed within the pump housing, and arranged to introduce the hydraulic fluid through the suction port to the pump chambers positioned in the region in which the internal volume of each of the pump chambers is increased; a discharge port formed in at least one of the second housing and the pressure plate, and opened in a region in which the internal volume of each of the pump chambers is decreased in accordance with the rotation of the rotor; a discharge passage formed within the pump housing, and arranged to introduce, through the discharge port to the outside, the hydraulic fluid discharged from the pump chambers positioned in the region in which the internal volume of each of the pump chambers is decreased; a first fluid pressure chamber separated radially between the adapter ring and the cam ring, on a side on which an internal volume is decreased when the cam ring is moved in a direction in which an eccentric amount of the cam ring is increased; a second fluid pressure chamber separated radially between the adapter ring and the cam ring, on a side on which an internal volume is increased when the cam ring is moved in a direction in which the eccentric amount of the cam ring is increased; a control section configured to control an internal pressure of the first fluid pressure chamber or the second fluid pressure chamber, and thereby to control the eccentric amount of the cam ring; a first fluid pressure chamber side high pressure introduction groove formed in a confronting surface of the second housing which confronts the cam ring, or in a confronting surface of the cam ring which confronts the second housing, formed so that an entire of the first fluid pressure chamber side high pressure introduction groove is positioned within a radial region of a radial width of the cam ring, and that a part of the first fluid pressure chamber side high pressure introduction groove is positioned in a circumferential region between a rotational terminal end of the suction port which is a terminal end of the suction port in the rotational direction of the rotor, and a rotational start end of the discharge port which is a start end of the discharge port in the rotational direction of the rotor, and arranged to receive a hydraulic pressure larger than the suction pressure within the suction port; and a second fluid pressure chamber side high pressure introduction groove formed in the confronting surface of the second housing which confronts the cam ring, or in the confronting surface of the cam ring which confronts the second housing, formed so that an entire of the second fluid pressure chamber side high pressure introduction groove is positioned within the radial region of the radial width of the cam ring, that a radial center of the second fluid pressure chamber side high pressure introduction groove is positioned at a position apart from a center of the cam ring with respect to a radial center of the radial width of the first fluid pressure chamber side high pressure introduction groove in a maximum eccentric state of the cam ring, and that a part of the second fluid pressure chamber side high pressure introduction groove is positioned in a circumferential region between a rotational terminal end of the discharge port which is a terminal end of the discharge port in the rotational direction of the rotor and a rotational start end of the suction port in the rotational direction of the rotor, and arranged to receive a hydraulic pressure larger than the suction pressure within the suction port.

DETAILED DESCRIPTION OF THE INVENTION

Hereinafter, variable displacement vane pumps according to embodiments of the present invention are illustrated in detail with reference to drawings.

Figure 1:
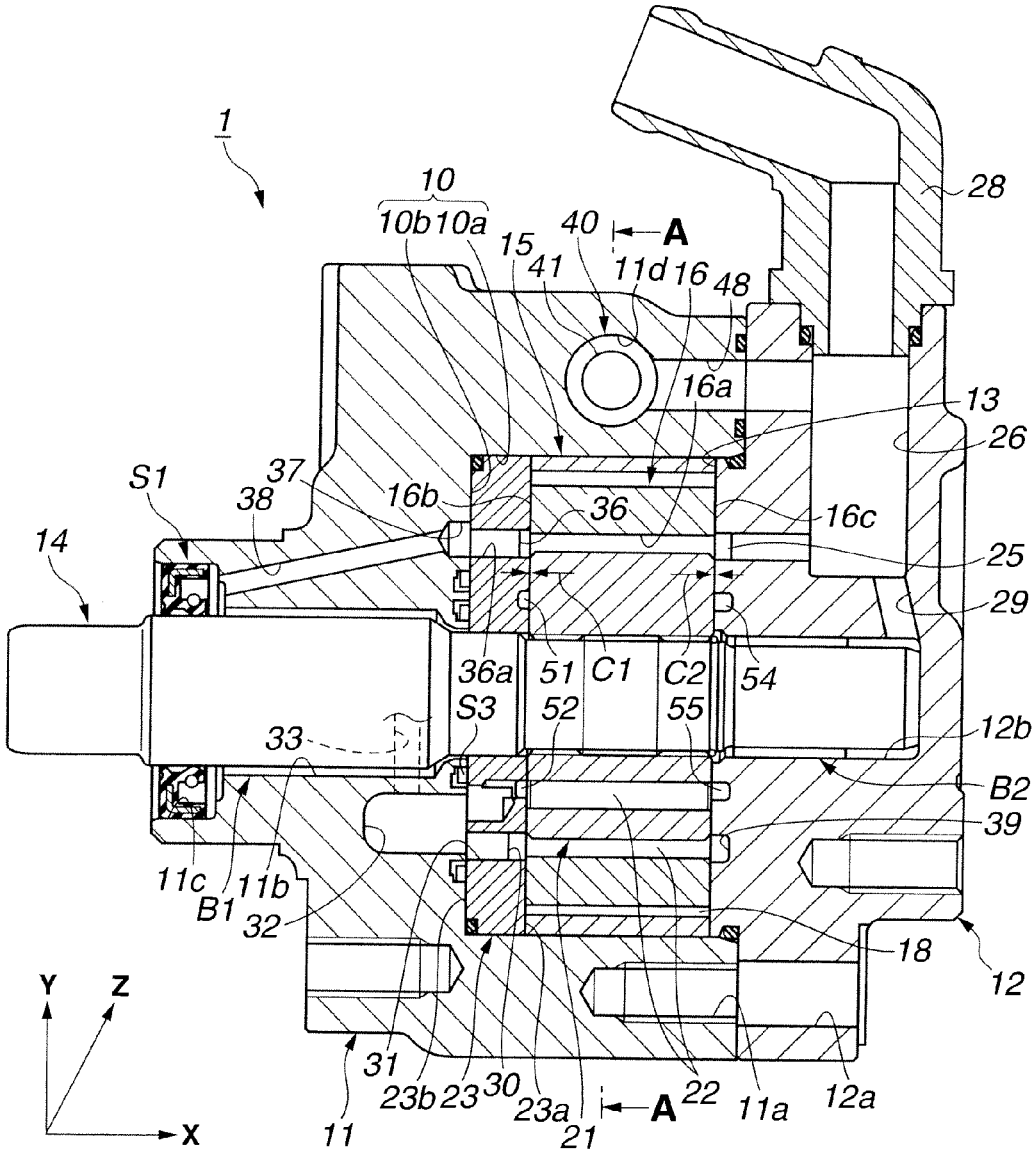
FIG. 1 is a longitudinal sectional view showing a variable displacement vane pump according to a present invention.

FIGS. 1-4 show a variable displacement vane pump according to a first embodiment of the present invention. As shown in FIG. 1, this variable displacement vane pump 1 includes a first housing 11 having a pump element receiving portion 10 which is a substantially cylindrical space, which is formed radially inside first housing 11 a first end side (right side of FIG. 1) of an axial direction in an inner radial part, and which has a first end side opening opened on the first end side surface of first housing 11; a second housing 12 closing the first end side opening of first housing 11; a drive shaft 14 rotatably supported by the pump housing; an adapter ring 15 which is a substantially circular shape, and which is mounted (fit) in a circumferential wall 10*a* of pump element receiving portion 10; a cam ring 16 which is disposed radially inside adapter ring 15, and which is movable to be eccentric to (off) from a center of drive shaft 14; a pump element which is disposed and received radially inside cam ring 16, and which performs a pump operation by being driven by drive shaft 14; and a control valve (control section) 40 configured to control a discharge flow rate (inherent discharge amount) of a hydraulic fluid which is discharged at one rotation of the pump element.

Figure 2:
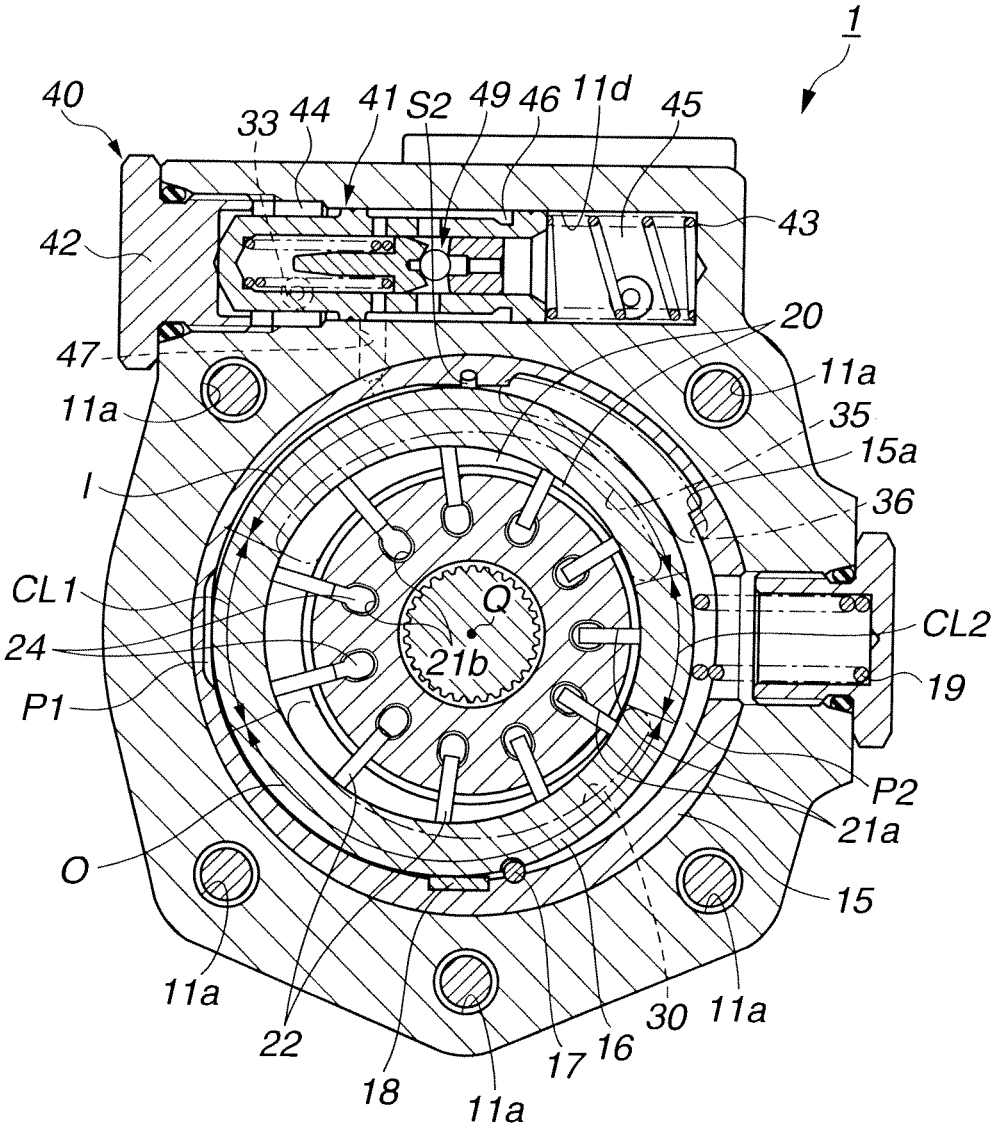
FIG. 2 is a sectional view taken along a section line A-A of FIG. 1.

As shown in FIGS. 1 and 2, each of the first and second housings 11 and 12 is made of an aluminum alloy. First housing includes 11 five internal threads 11*a* opened in the first end side surface. Second housing 12 includes five bolt insertion holes 12*a* which are located, respectively, at positions corresponding to the positions of internal threads 11 on the radially outer portion (outer circumference portion) of second housing 12, and which penetrate second housing 12. Five mounting bolts (not shown) are inserted through bolt insertion holes 12*a*, and screwed into internal threads 11, so that first and second housings 11 and 12 are joined. Second housing 12 includes a mounting raised portion 13 which is formed on a surface confronting the first end side surface of first housing 11, which protrudes toward first housing 11, and which is mounted (fit) in the first end side opening of first housing 11. This mounting raised portion 13 closes the first end side opening of first housing 11.

As shown in FIG. 1, drive shaft 14 is inserted radially within first housing 11 in the axial direction so as to pass through a center of pump element receiving portion 10. Drive shaft 14 includes a first end (on the left side of FIG. 1) supported by a first bearing B1 which is received and retained by a bearing retaining portion 11*b* that is formed radially inside first housing 11 on a second end side (left side of FIG. 1) of first housing 11 in the radially inner portion (inner circumference portion) of first housing 11, and a second end (on the right side of FIG. 1) supported by a second bearing B2 which is received and retained by a bearing retaining portion 12*b* formed in an end surface of mounting raised portion 13 of second housing 12. Drive shaft 14 is driven and rotated in a counterclockwise direction of FIG. 2 by a rotation force (torque) transmitted from the outside through a pulley (not shown) and so on which is fixed on the outer circumference of the first end of drive shaft 14 so as to rotate as a unit with drive shaft 14.

First bearing B1 and second bearing B2 are lubricated by the hydraulic fluid leaked from pump chambers 20 described later though axial clearances C1 and C2 described later. Moreover, first housing 11 includes a seal retaining groove 11*c* which is formed radially inside first housing 11 in the second end portion of first housing 11, and which has a stepped shape so as to increase the radius from the bearing holding portion 11*b* toward the second end surface of first housing 11. A seal member S1 is disposed in seal retaining groove 11*c* of first housing 11, and arranged to liquid-tightly seal a radial clearance between an inner circumferential surface of the second end portion of first housing 11 and an outer circumference surface of drive shaft 14. With this, it is possible to suppress the leakage of the hydraulic fluid which lubricates first bearing B1 to the outside.

As shown in FIG. 2, adapter ring 15 includes an inner circumference surface formed into a substantially elliptical shape. Adapter ring 15 includes a support groove which has an arc cross section, which is formed on the inner circumference surface of adapter ring 15 at a predetermined circumferential position, and which extends in the axial direction. A position retaining pin 17 is received and retained in the support groove of adapter ring 15. Position retaining pin 17 is arranged to retain the circumferential position of cam ring 16. A plate member 18 with a predetermined width is disposed on the inner circumference surface of adapter ring 15 near the support groove on a first fluid pressure chamber P1's side of the support groove. Plate member 18 serves as a swing support surface of cam ring 16. Position retaining pin 17 is not a swing point of cam ring 16 about which cam ring 16 is swung. Position holding pin 17 serves as a rotation preventing member for cam ring 16, which is for preventing the rotation of cam ring 16 with respect to adapter ring 15. Moreover, adapter ring 15 includes a retaining groove which has a substantially rectangular cross section, which is located at a position to confront plate member 18 in the radial direction (which is opposite to plate member 18 in the radial direction), and which extends in the axial direction. A seal member S2 is received and retained by this retaining groove of adapter ring 15. Seal member S2 is urged in a radially inward direction of cam ring 15 by an elastic (resilient) member. In this way, a first fluid pressure chamber P1 and a second fluid pressure chamber P2 are separated on left and right sides of FIG. 2 radially between adapter ring 15 and cam ring 16 by plate member 18 and seal member S2. First fluid pressure chamber P1 and second fluid pressure chamber P2 serve for a control of the swing movement of cam ring 16.

A coil spring 19 is disposed in second fluid pressure chamber P2. One end of coil spring 19 is retained by a substantially bolt shaped retainer. Cam ring 16 is always urged on the first fluid pressure chamber P1's side, that is, in a direction to increase the eccentric amount of cam ring 16 with respect to the center of drive shaft 14.

Cam ring 16 is made from a sintered material made by sintering an iron metal material, or an iron metal material (iron-based metal material). A part of an outer circumference surface of cam ring 16 is supported by plate member 18 which forms the swing surface. Cam ring 16 is arranged to be swung about the swing surface to the first fluid pressure chamber P1's side or to the second fluid pressure chamber P2' side so as to be off (eccentric from) the center of drive shaft 14.

The pump element is rotatably received radially inside cam ring 16. The pump element includes a substantially disc-shaped rotor 21 which is rotatably received radially inside cam ring 16, and which is driven and rotated by drive shaft 14, and a plurality of vanes 22 each of which is shaped like a rectangular plate, and which are received and held on the outer circumference side of rotor 21 to be moved radially inward or outward.

Rotor 21 is mounted (fit) on the outer circumference of drive shaft 14 through splines to rotate as a unit with drive shaft 14. Rotor 21 includes a plurality of slits 21*a* each of which has a substantially rectangular cross section, which are formed at regular intervals in the circumferential direction, and each of which extends in the radial direction. Each of vanes 22 is held by one of the slits 21*a* to be moved into or out of the one of slits 21 in the radial direction. Moreover, rotor 21 includes back pressure grooves 21*b* each of which has a substantially circular section, each of which is formed on an inner circumferential end of the one of slits 21*a* to be integral with the one of slits 21*a*, and each of which extends in the axial direction. Each of vanes 22 is moved out of the one of slits 21*a* in the radially outward direction by an inner pressure of a back pressure chamber 24 defined by one of back pressure grooves 21*b* and a base end portion (an inner circumferential end) of one of vanes 22, and a centrifugal force according to the rotation of rotor 21. By the thus-constructed structure, vanes 22 are moved out of slits 21*a* when rotor 21 is rotated, so that the outer circumferential ends of vanes 22 always contact an inner circumference surface 16*a* of cam ring 16. With this, a plurality of pump chambers 20 described later are separated.

Moreover, rotor 21 and cam ring 16 are sandwiched and held from the axial direction by a substantially circular pressure plate 23 which is received in the inner end surface (bottom surface) of pump element receiving portion 10, and mounting raised portion 13 of second housing 12. With this, in a portion radially between cam ring 16 and rotor 21, each of the plurality of pump chambers 20 is defined in the circumferential direction by adjacent two of vanes 22 and 22, pressure plate 23 and mounting raised portion 13 of second housing 12. Cam ring 16 is swung about the swing support surface, so that the volumes of pump chambers 20 are decreased or increased.

Figure 4:
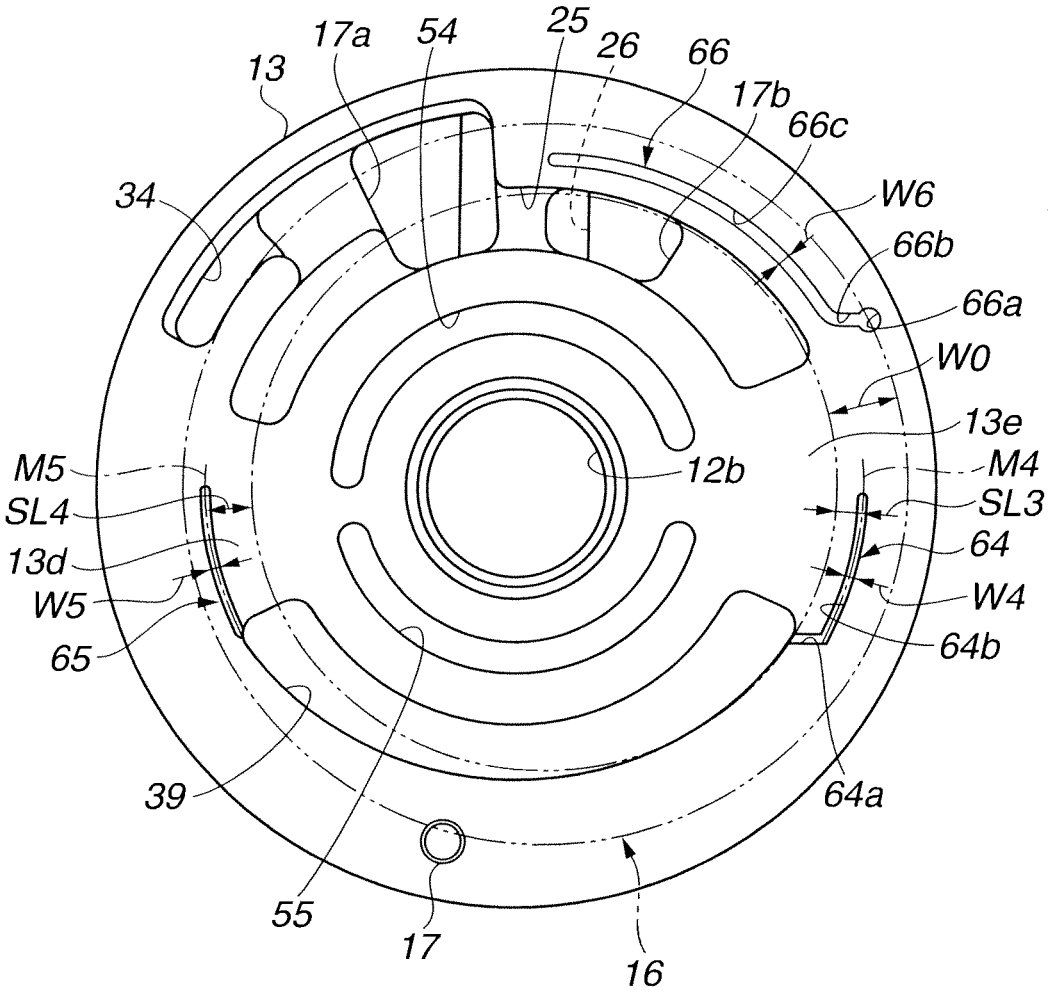
FIG. 4 is a view which is for illustrating a main part of the variable displacement vane pump according to the first embodiment of the present invention, and in which a second housing shown in FIG. 1 is viewed from the cam ring side.

As shown in FIGS. 1 and 4, a first suction port (suction port) 25 is formed (cut) on the end surface of mounting raised portion 13, at a position corresponding to a suction region I in which the inside volumes of pump chambers 20 are gradually increased in accordance with the rotation of rotor 21. First suction port 25 is shaped like a substantially arc groove. First suction port 25 confronts pump chambers 20 located at the positions of suction region I. A pair of first and second suction holes 17*a* and 17*b* are formed at substantially circumferential central positions of this first suction port 25. The pair of first and second suction holes 17*a* and 17*b* are opened to a suction passage 26 formed from an upper end of second housing 12 to have a substantially L-shaped longitudinal cross section. The pair of first and second suction holes 17*a* and 17*b* penetrate in the positive direction of the X-axis. That is, the hydraulic fluid is introduced from a reservoir tank (not shown) storing the hydraulic fluid, through a suction pipe 28 to suction passage 26. Moreover, this hydraulic fluid is supplied through both of suction holes 17*a* and 17*b* and first suction port 25 to pump chambers 20.

Moreover, as shown in FIG. 1, a recirculating passage 29 is formed in the end surface of mounting raised portion 13. Recirculating passage 29 connects bearing recessed portion 12*b* and suction passage 26. This recirculating passage 29 recirculates, to suction passage 26, the hydraulic fluid which is leaked from pump chambers 20 through axial clearance C2 between the end surface of mounting raised portion 13 and a first end surface of rotor 21 confronting the end surface of mounting raised portion 12. With this, the hydraulic fluid leaked from pump chambers 20 to the second housing 12's side is again introduced through both of suction holes 17*a* and 17*b* to first suction port 25.

Figure 3:
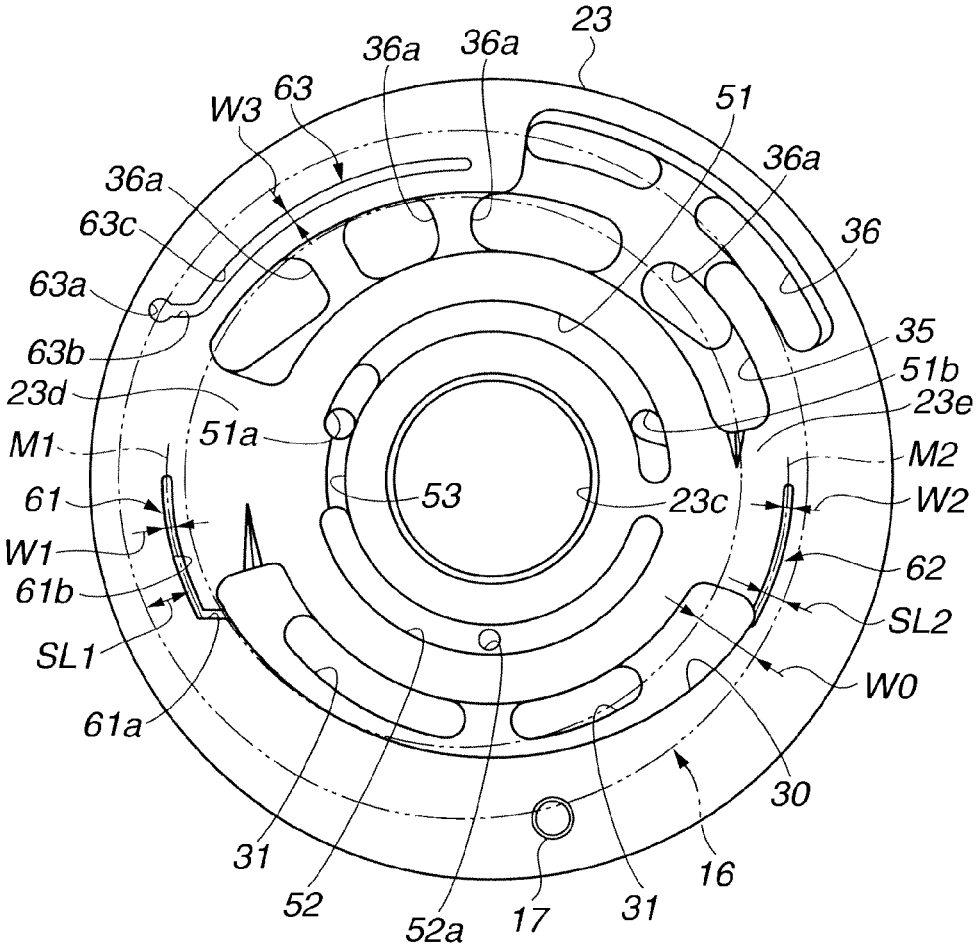
FIG. 3 is a view which is for illustrating a main part of the variable displacement vane pump according to the first embodiment of the present invention, and in which a pressure plate shown in FIG. 1 is viewed from a cam ring side.

On the other hand, as shown in FIGS. 1 and 3, a first discharge port (discharge port) 30 is formed on a surface of pressure plate 23 confronting rotor 21, at a position corresponding to a discharge region O in which the inside volumes of pump chambers 20 are gradually decreased in accordance with the rotation of rotor 21. First discharge port 30 is shaped like a substantially arc groove. A plurality of discharge holes 31 are formed at predetermined circumferential positions of first discharge port 30. The plurality of discharge holes 31 are connected with an arc groove-shaped pressure chamber 32 formed on inner end surface (bottom surface) 10*b* of pump element receiving portion 10 to overlap with first discharge port 30 in the axial direction. Each of the plurality of discharge holes 31 penetrates in the negative direction of the X-axis of FIG. 1. That is, the hydraulic fluid pressurized by pump chambers 20 corresponding to discharge region O is discharged to first discharge port 30. Then, the hydraulic fluid is introduced through discharge holes 31 to pressure chamber 32. Moreover, the hydraulic fluid is discharged through a discharge passages 33 formed within first housing 11, to the outside.

Discharge passage 33 are formed in a bifurcated shape from pressure chamber 32. One of discharge passages 33 is connected to a high pressure chamber 44 described later which is positioned on the left side of FIG. 2, and which is separated by a valve element 41 of control valve 40. The other of discharge passages 33 is connected through a metering orifice (not shown) to the outside.

As shown in FIGS. 1 and 2, control valve 40 is disposed in an upper portion of first housing 11 on the first end side of first housing 11 along the Z-axis direction of FIG. 1. Control valve 40 includes a valve element 41 slidably received in a valve hole 11*d* formed in the upper portion of first housing 11; a plug 42 screwed in a first end side opening portion of valve hole 11*d*; a valve spring 43 arranged to urge valve element 41 in the leftward direction of FIG. 2 so as to abut on plug 42; a high pressure chamber 44 which is separated between the end portions of plug 42 and valve element 41, and into which the hydraulic pressure on the upstream side of the metering orifice (not shown), that is, a part of the discharge fluid within pressure chamber 32 is introduced through the one of discharge passage 33; and a middle pressure chamber 45 which receives valve spring 43, and into which the hydraulic pressure on the downstream side of the metering orifice is introduced. Valve element 41 is moved against the urging force of valve spring 43 in the rightward direction of FIG. 2 when the pressure difference between high pressure chamber 44 and middle pressure chamber 45 becomes equal to or greater than a predetermined value.

When valve element 41 is positioned on the left side of FIG. 2, first fluid pressure chamber P1 is connected through a connection passage 47 connecting first fluid pressure chamber P1 and valve hole 11*d*, to a low pressure chamber 46 separated radially outside the central portion of valve element 41. As shown in FIG. 1, low pressure chamber 46 is connected with a low pressure passage 48 formed by bifurcating from suction passage 26. The hydraulic fluid with the low pressure (hereinafter, referred to as suction pressure) within suction passage 26 is introduced through low pressure 48 to low pressure chamber 46. That is, when valve element 41 is positioned on the left side of FIG. 2, the suction pressure is introduced from low pressure chamber 46 to first fluid pressure chamber P1.

On the other hand, when valve element 41 is moved in the rightward direction of FIG. 2 by the pressure difference between high pressure chamber 44 and middle pressure chamber 45, a connection between first fluid pressure chamber P1 and low pressure chamber 46 is shut off. First fluid pressure chamber P1 is connected with high pressure chamber 44. The hydraulic fluid with the high pressure within discharge passage 33 (hereinafter, referred to as a discharge passage) is introduced into first fluid pressure chamber P1. In this way, the suction pressure of low pressure chamber 46 and the discharge pressure on the upstream side of the metering orifice are selectively supplied to the first fluid pressure chamber P1.

As shown in FIG. 2, control valve 40 includes a relief valve 49 disposed within valve element 41. When the inner pressure of middle pressure chamber 45 becomes equal to or greater than a predetermined value, that is, when the pressure on the load side of the outside becomes equal to or greater than a predetermined value, relief valve 48 is released so as to recirculate a part of the hydraulic fluid through low pressure passage 48 to suction passage 26.

On the other hand, as shown in FIGS. 2 and 4, second fluid pressure chamber P2 is connected to first suction hole 17*a* through a first suction pressure introduction port 34 which is shaped like a substantially arc groove, which is formed on the end surface of mounting raised portion 13, and which is adjacent to a region radially outside a rotational start end portion of first suction port 25 that is a start end portion in the rotational direction of rotor 21. An inner circumferential side of first suction pressure introduction port 34 is connected with first suction port 25. An outer circumferential side of first suction pressure introduction port 34 is opened to be connected with second fluid pressure chamber P2. With this, the suction pressure is constantly introduced into the second fluid pressure chamber P2. By the thus-constructed structure, second fluid pressure chamber P2 is constantly pressed toward the first fluid pressure chamber P1's side mainly by the urging force of coil spring 19.

As shown in FIGS. 2 and 3, a second suction port (suction port) 35 is formed on a first side surface 23*a* of pressure plate 23 at a position to confront first suction port 25 through rotor 21 in the axial direction. Second suction port 35 has a shape substantially identical to a shape of first suction port 25. Second suction port 35 is separated by a pair of partition walls 23*d* and 23*e* each having a circumferential width larger than one of pump chambers 20 with respect to the adjacent first discharge port 30. A second suction pressure introduction port 36 is formed so as to be adjacent to a region radially outside a rotational start end portion of second suction port 35 that is a start end portion of second suction port 35 in the rotational direction of rotor 21. Second suction pressure introduction port 36 has a shape substantially identical to first suction pressure introduction port 34. This second suction pressure introduction port 36 is connected through second fluid pressure chamber P2 to first suction pressure introduction port 34 confronting second suction pressure introduction port 36. The suction pressure is introduced from the first suction pressure introduction port 34 into second suction pressure introduction port 36. With this, a part of the hydraulic fluid which corresponds to the suction pressure, and which is introduced into second fluid pressure chamber P2 is introduced into second suction pressure introduction port 36. Then, the hydraulic fluid corresponding to the suction pressure is introduced through second suction pressure introduction port 36 to second suction port 35.

A plurality of connection holes 36*a* are formed at predetermined circumferential positions of second suction port 35, and connected with a connection port 37 which is formed into a substantially arc shape, and which is formed in the inner end surface (bottom surface on the left side of FIG. 1) 10*b* of pump element receiving portion 10 to be overlapped with second suction port 35 on the back side in the axial direction. Each of connection holes 36*a* extends in the negative direction of the X-axis, and penetrate through pressure plate 23. Connection port 37 is connected through a connection passage 38 formed within the second end portion of first housing 11, to bearing retaining portion 11*b*. With this, the hydraulic fluid leaked from pressure chambers 20 through axial clearance C1 between first surface 23*a* of pressure plate 23 and the other surface of rotor 21 which confronts first surface 23*a* of pressure plate 23 is introduced through connection passage 38 to connection port 37, and then recirculated from connection port 37 through connection holes 36*a* to second port 35.

As shown in FIG. 1, a seal member S3 is disposed on the inner end surface 10*b* of pump element receiving portion 10. Seal member S3 surrounds connection port 37 and drive shaft insertion hole 23*c* through which drive shaft 14 passes. Seal member S3 has a variant longitudinal section, and endless shape. Seal member S3 separates the second side surface 23*b* of pressure plate 23 into the low pressure region connected with the suction side, and the high pressure region connected with the discharge side. The low pressure region corresponds to a region radially inside seal member S3 which is set to a relatively small region. The high pressure region corresponds to a region radially outside seal member S3 which is the large region of the second side surface 23*b* of pressure plate 23. With this, the discharge pressure is acted to the large part on second side surface 23*b* of pressure plate 23.

As shown in FIGS. 1 and 4, second discharge port (discharge port) 39 is formed on the end surface of mounting raised portion 13 at a position to confront first discharge port 30 to sandwich rotor 21 in the axial direction. Second discharge port 39 has a shape substantially identical to the shape of first discharge port 30. This second discharge port 39 is separated by a pair of partition walls 13*d* and 13*e* each having a circumferential width larger than a circumferential width of one of pump chambers 20, with respect to the adjacent first suction port 25.

As shown in FIG. 2, each of partition walls 13*d*, 13*e*, 23*d* and 23*e* has the circumferential width larger than the circumferential width of one of pump chambers 20. A first closed portion CL1 and a second closed portion CL2 are formed circumferentially between suction ports 35 or 25, and discharge ports 30 or 39, by partition walls 13*d* and 23*d*, and partition walls 13*e* and 23*e* which are pairs in the axial direction. Each of first closed portion CL1 and second closed portion CL2 is not connected to any ports.

In this way, in variable displacement vane pump 1, suction ports 35 and 25, and discharge ports 30 and 39 are formed on first side surface 23*a* of pressure plate 23 and the end surface of mounting raised portion 13 so that suction ports 25 and 35, and discharge ports 30 and 39 are substantially symmetrical to each other in the axial direction. With this, the pressure balance is maintained in the axial direction of pump chambers 20.

As shown in FIGS. 1 and 3, a first suction side back pressure port 51 and a first discharge side back pressure port 52 are formed on first side surface 23*a* of pressure plate 23 in suction region I and discharge region O in predetermined circumferential regions which confront back pressure chambers 24 corresponding to suction region I and discharge region O. Each of first suction side back pressure port 51 and first discharge side back pressure port 52 is shaped like a substantially arc groove. A rotational terminal end portion of first suction side back pressure port 51 in the rotational direction of rotor 21 and a rotational start end of first discharge side back pressure port 52 in the rotational direction of rotor 21 are connected with each other through a connection groove 53 having a predetermined radial width so that these back pressure ports 51 and 52 are connected with each other. First suction side back pressure port 51 includes pressure introduction holes 51*a* and 51*b* formed on the both end sides of first suction side back pressure port 51. First suction side back pressure port 51 is connected through pressure introduction holes 51*a* and 51*b* to the high pressure region provided on the back surface side of pressure plate 23 so as to introduce the discharge pressure to the inside. First discharge side back pressure port 52 includes a pressure introduction hole 52*a* formed at a central portion in the circumferential direction, and opened to pressure chamber 32 formed on the back surface side, so as to penetrate through pressure plate 23. The discharge pressure is introduced through pressure introduction hole 52*a* to the inside of first discharge side back pressure port 52. That is, the discharge pressure is introduced through pressure introduction holes 51*a*, 51*b* and 52*a* to first suction side back pressure port 51 and first discharge side back pressure port 52. With this, the discharge pressure is supplied to back pressure chambers 24 confronting suction region I and discharge region O.

Similarly, as shown in FIGS. 1 and 4, a second suction side back pressure port 54 and a second discharge side back pressure port 55 are formed on the end surface of mounting raised portion 13 in suction region I and discharge region O in a predetermined circumferential region which confront back pressure chambers 24 corresponding to suction region I and discharge region O. Each of second suction side back pressure port 54 and second discharge side back pressure port 55 is shaped like a substantially arc groove. Back pressure ports 54 and 55 are connected, respectively, through back pressure chambers 24 confronting back pressure ports 54 and 55, to back pressure ports 51 and 52 on the pressure plate 23's side. By back pressure ports 54 and 55, back pressure chambers 24 in suction region I and discharge region O are connected with each other on the second housing 12's side.

As shown in FIG. 3, a pair of first high pressure introduction groove (plate side high pressure introduction groove, first fluid pressure chamber side high pressure introduction groove) 61 and a second high pressure introduction groove (plate side high pressure introduction groove, second fluid pressure chamber side high pressure introduction groove) 62 are formed in first side surface 23*a* of pressure plate 23. Each of first high pressure introduction groove 61 and second high pressure introduction groove 62 is a narrow groove with a predetermined width. First high pressure introduction groove 61 and second high pressure introduction groove 62 extend from both ends of first discharge port 30. First high pressure introduction groove 61 and second high pressure introduction groove 62 receive the discharge pressure within first discharge port 30. Moreover, a first pressure introduction groove 63 is formed in a region radially outside the rotational terminal end of second suction port 35 in the rotational direction of rotor 21. First pressure introduction groove 63 is connected with first fluid pressure chamber P1 to introduce the control pressure of cam ring 16 within first fluid pressure chamber P1 to first pressure introduction groove 63. The hydraulic fluid is supplied through introduction grooves 61-63 to axial clearance C1. With this, lubricating property (lubricity) between cam ring 16 and pressure plate 23 at the swing movement of cam ring 16 is improved, and unbalanced abrasion of the confronting surfaces between cam ring 16 and pressure plate 23 at the swing movement of cam ring 16 is suppressed.

First high pressure introduction groove 61 includes a radial extension portion 61*a* extending in the radially outward direction from the rotational start end of first discharge port 30 in the rotational direction of rotor 21, and a circumferential extension portion 61*b* extending in the circumferential direction from an end of radial extension portion 61*a* toward the second suction port 36's side. First high pressure introduction groove 61 is formed to satisfy at least two conditions described below.

A first condition is that an entire of first high pressure introduction groove 61 is formed in a region of a radial width W0 of cam ring 16. That is, a radial offset amount of circumferential extension portion 61*b* by radial extension portion 61*a* in the radial direction is set so that circumferential extension portion 61*b* of first high pressure introduction groove 61 is positioned in a radial region radially outside an inner circumference edge of cam ring 16 in the maximum eccentric state of cam ring 16, and that circumferential extension portion 61*b* is positioned in a radial region radially inside an outer circumferential edge of cam ring 16 in the minimum eccentric state of cam ring 16.

Moreover, a second condition is that first high pressure introduction groove 61 is formed so that at least a part of circumferential extension portion 61*b* is positioned in a circumferential region between the rotational terminal end of second suction port 35 in the rotational direction of rotor 21 and the rotational start end of first discharge port 30 in the rotational direction of rotor 21, that is, in a circumferential region corresponding to first closed portion CL1.

That is, in first high pressure introduction groove 61, the first condition considers the swing movement of cam ring 16. The radial position of circumferential extension portion 61*b* is positioned near the inner circumferential side of cam ring 16 in the maximum eccentric state of cam ring 16 so as not to be deviated from radial width W0 of cam ring 16 in the swing movement region of cam ring 16. With this, first seal width SL1 which is the seal width between pressure plate 23 and cam ring 16 on the outer circumference side of circumferential extension portion 61*b* is largely ensured.

From the second condition, this first high pressure introduction groove 61 is formed so that the extension position of the end of circumferential extension portion 61*b* is positioned nearer to the rotational terminal end of first discharge port 30 in the rotational direction of rotor 21 than to the rotational start end of second suction port 35 in the rotational direction of rotor 21. That is, first high pressure introduction groove 61 is formed so that an end of circumferential extension portion 61*b* is positioned at a substantially central position of the circumferential region of first closed position CL1.

Second high pressure introduction groove 62 extends in the circumferential direction from an outer circumferential edge of the rotational terminal end portion of first discharge port 30 in the rotational direction of rotor 21, toward second suction port 35. Second high pressure introduction groove 62 is formed so as to satisfy at least three conditions described below.

A first condition is that an entire of second high pressure introduction groove 62 is positioned in a radial region of radial width W0 of cam ring 16. That is, this second high pressure introduction groove 62 is positioned in the maximum eccentric state of cam ring 16 in a radial region radially inside the outer circumferential edge of cam ring 16. Second high pressure introduction groove 62 is positioned in the minimum eccentric state of cam ring 16 in a radial region radially outside the inner circumference edge of cam ring 16.

A second condition is that second high pressure introduction groove 62 is formed so that a center M2 of radial width W2 in the maximum eccentric state of cam ring 16 is positioned at a position which is apart from the center of cam ring 16 relative to center M1 of radial width W1 of circumferential extension portion 61*b* of first high pressure introduction groove 61. That is, this second high pressure introduction groove 62 is offset relative to first high pressure introduction groove 61 to the circumferential region radially outside first high pressure introduction groove 61 (in the radially outward direction).

A third condition is that at least a part of second high pressure introduction groove 62 is positioned in a circumferential region between the rotational terminal end of first discharge port 30 in the rotational direction of rotor 21 and the rotational start end of second suction port 35 in the rotational direction of rotor 21, that is, in the circumferential region corresponding to second closed portion CL2.

That is, in second high pressure introduction groove 62, the first and second conditions consider the swing movement of cam ring 16. Second high pressure introduction groove 62 is positioned radially outside the inner circumferential edge of cam ring 16 in the minimum eccentric state of cam ring 16. Moreover, second high pressure introduction groove 62 is positioned radially outside first high pressure introduction groove 61 in the maximum eccentric state of cam ring 16 so as to be positioned near the radially inner side of cam ring 16. That is, second high pressure introduction groove 62 is formed so that second seal width SL2 which is a seal width between pressure plate 23 and cam ring 16 on the outer circumferential side is largely ensured so as not to be deviated from the region of radial width W0 of cam ring 16 within the swing movement region of cam ring 16.

Moreover, from the third condition, second high pressure introduction groove 62 is formed so that the extension position of the end of second high pressure introduction groove 62 is positioned at a position nearer to the rotational terminal end of first discharge port 30 in the rotational direction of rotor 21 than to the rotational start end of second discharge port 35 in the rotational direction of rotor 21. In particular, second high pressure introduction groove 62 is formed so that the end of second high pressure introduction groove 62 is positioned at a substantially central position of the circumferential region of second closed portion CL2.

On the other hand, first pressure introduction groove 63 is formed into a narrow groove, like high pressure introduction grooves 61 and 62. First pressure introduction groove 63 includes an introduction portion 63*a* which is shaped like a substantially spherical recessed portion, which is constantly opened to first fluid pressure chamber P1 within the swing movement region of cam ring 16, and which is arranged to introduce the control pressure of cam ring 16 within first fluid pressure chamber P1 (hereinafter, referred to as control pressure) to first pressure introduction groove 63, a radial extension portion 63*b* extending from introduction portion 63*a* in the radially inward direction of pressure plate 23, and a circumferential extension portion 63*c* extending in the circumferential direction from the end of radial extension portion 63*b* toward second suction pressure introduction port 36 to a portion near second suction pressure introduction port 36. Pressure introduction groove 63 serves for lubricating the portion between one side surface 23*a* of pressure plate 23 and first side surface 16*b* of cam ring 16 on the outer circumferential region of (a region radially outside) the terminal end portion of second suction port 35 in the rotational direction of rotor 21.

Introduction grooves 61-63 are formed so that radial widths W1-W3 in a cross section are substantially constant in the groove depth direction, that is, so that introduction grooves 61-63 have substantially rectangular cross sections. By the thus-constructed introduction grooves 61-63, it is possible to increase the cross section areas of the flow passages of the introduction grooves 61-63. Introduction grooves 61-63 serve for effectively lubricating the portion between cam ring 16 and pressure plate 23.

As shown in FIG. 4, a pair of third high pressure introduction groove (housing side high pressure introduction groove, first fluid pressure chamber side high pressure introduction groove) 64 and a fourth high pressure introduction groove (housing side high pressure introduction groove, second fluid pressure chamber side high pressure introduction groove) 65 are formed on the end surface of mounting raised portion 13, like first side surface 23*a* of pressure plate 23. Third high pressure introduction groove 64 and fourth high pressure introduction groove 65 extend from both end portions of second discharge port 39. Each of third high pressure introduction groove 64 and fourth high pressure introduction groove 65 is a narrow groove having a predetermined width. Moreover, a second pressure introduction groove 66 is formed on the outer circumferential side of (radially outside) the rotational terminal end portion of first suction port 25 in the rotational direction of rotor 21. Second pressure introduction groove 66 is formed substantially at a position to confront first pressure introduction groove 63 on the pressure plate 23's side. Second pressure introduction groove 66 is connected with first fluid pressure chamber P1 to receive the control pressure within first fluid pressure chamber P1. The hydraulic pressure is supplied to axial clearance C2 at the swing movement of cam ring 16 through introduction grooves 64-66. With this, it is possible to improve the lubricating property (lubricity) between cam ring 16 and mounting raised portion 13 at the swing movement of cam ring 16, and to suppress the unbalanced abrasion of the confronting surfaces between cam ring 16 and mounting raised portion 13 by the eccentric movement of cam ring 16.

Third high pressure introduction groove 64 includes a radial extension portion 64*a* extending radially outwards from the rotational start end of second discharge port 39 in the rotational direction of rotor 21, and a circumferential extension portion 64*b* extending in the circumferential direction from an end of radial extension portion 64*a* toward first suction port 25. Moreover, third high pressure introduction groove 64 is formed so as to satisfy at least four conditions described later.

That is, a first condition is that third high pressure introduction groove 64 is formed so that the entire of third high pressure introduction groove 64 is positioned in a radial region of radial width W0 of cam ring 16. A radial offset amount of circumferential extension portion 64*b* in the radial direction by radial extension portion 64*a* is set so that circumferential extension portion 64*b* is positioned in the maximum eccentric state of cam ring 16 in a radial region radially outside the inner circumferential edge of cam ring 16, and so that circumferential extension groove 64*b* is positioned in the minimum eccentric state of cam ring 16 in a radial region radially inside the outer circumferential edge of cam ring 16.

A second condition is that a center M4 of radial width W4 of circumferential extension portion 64*b* is positioned radially outside center M1 of radial width M1 of circumferential extension portion 61*b* of first high pressure introduction groove 61. That is, this third high pressure introduction groove 64 is formed to be offset to the circumferential region radially outside first high pressure introduction groove 61 (in the radially outward direction) relative to first high pressure introduction groove 61.

Moreover, a third condition is that third high pressure introduction groove 64 is formed so that a part of circumferential extension portion 64*b* is positioned in a circumferential region between the rotational terminal end of first suction port 25 in the rotational direction of rotor 21 and the rotational start end of second discharge port 39 in the rotational direction of rotor 21, that is, in a circumferential region corresponding to first closed portion CL1.

A fourth condition is that a part of third high pressure introduction groove 64 is overlapped with first high pressure introduction groove 61 in the circumferential direction. That is, in this embodiment, radial extension portion 64*a* of third high pressure introduction groove 64 is overlapped with radial extension portion 61*a* of first high pressure introduction groove 61 in the axial direction. With this, the pressure valance between the mounting raised portion 13's side and the pressure plate 23's side is improved.

In third high pressure introduction groove 64, the first and second conditions consider the swing movement of cam ring 16. Third high pressure introduction groove 64 is positioned in a circumferential region radially outside first high pressure introduction groove 61 in a region so as not to be deviated from the region of radial width W0 of cam ring 16 in the swing movement region of cam ring 16. Moreover, third high pressure introduction groove 64 is formed so that the radial position of circumferential extension portion 64*b* in the maximum eccentric state of cam ring 16 is positioned near the outer circumferential side of cam ring 16. With this, third seal width SL3 which is the seal width between mounting raised portion 13 and cam ring 16 on the inner circumference side of circumferential extension portion 64*b* is largely ensured.

Moreover, from the third condition, the extension position of the end of circumferential extension portion 64*b* of third high pressure introduction groove 64 is positioned nearer to the rotational start end of second discharge portion 39 in the rotational direction of rotor 21 than to the rotational terminal end of first suction portion 25 in the rotational direction of rotor 21. That is, the end of circumferential extension portion 64*b* is positioned at a substantially central position of the circumferential region of first closed portion CL1.

On the other hand, fourth high pressure introduction groove 65 extends in the circumferential direction from an outer circumferential edge of the rotational terminal end of second discharge port 39 in the rotational direction of rotor 21 toward first suction port 25. Fourth high pressure introduction groove 65 is formed to satisfy at least five conditions described below.

A first condition is that the entire of fourth high pressure introduction groove 65 is positioned within the region of radial width W0 of cam ring 16. That is, this fourth high pressure introduction groove 65 is positioned in the maximum eccentric state of cam ring 16 in a radial region radially inside the outer circumference edge of cam ring 16. Moreover, fourth high pressure introduction groove 65 is positioned in the minimum eccentric state of cam ring 16 in a radial region radially outside the inner circumference edge of cam ring 16.

A second condition is that fourth high pressure introduction groove 65 is formed so that a center M5 of radial width W5 of fourth high pressure introduction groove 65 is positioned radially outside center M2 of radial width W2 of second high pressure introduction groove 62. Fourth high pressure introduction groove 65 is formed to be offset to a circumferential region radially outside second high pressure introduction groove 62 (in the radially outward direction) relative to second high pressure introduction groove 62.

A third condition is that fourth high pressure introduction groove 65 is formed so that center M5 of radial width W5 of fourth high pressure introduction groove 65 in the maximum eccentric state is positioned at a position which is apart from the center of cam ring 16 with respect to center M4 of radial width W4 of circumferential extension portion 64*b* of third high pressure introduction groove 64. That is, fourth high pressure introduction groove 65 is formed to be offset to a circumferential region radially outside third high pressure introduction groove 64 (in the radially outward direction) relative to third high pressure introduction groove 64.

A fourth condition is that fourth high pressure introduction groove 65 is formed so that a part of fourth high pressure introduction groove 65 is positioned in a circumferential region between the rotational terminal end of second discharge port 39 in the rotational direction of rotor 21 and the rotational start end of first suction port 25 in the rotational direction of rotor 21, that is, a circumferential region corresponding to second closed portion CL2.

A fifth condition is that fourth high pressure introduction groove 65 is formed so that a part of fourth high pressure introduction groove 65 is overlapped with second high pressure introduction groove 62 in the circumferential direction. That is, in this embodiment, the most part (large part) of fourth high pressure introduction groove 65 is overlapped with second high pressure introduction groove 62 in the axial direction. The pressure balance between the mounting raised portion 13's side and the pressure plate 23's side on the second fluid pressure chamber P2's side is improved, like the first fluid pressure chamber P1's side.

In the thus-constructed fourth high pressure introduction groove 65, the conditions 1-3 consider the swing movement of cam ring 16. Fourth high pressure introduction groove 65 is formed so that the radial position of fourth high pressure introduction groove 65 is positioned in the maximum eccentric state of cam ring 16 in a radial region radially inside the outer circumference edge of cam ring 16. Moreover, fourth high pressure introduction groove 65 is positioned in the maximum eccentric state of cam ring 16, radially outside first high pressure introduction groove 61 and third high pressure introduction groove 64. Furthermore, fourth high pressure introduction groove 65 is positioned near the outer circumference edge of cam ring 16 in the maximum eccentric state of cam ring 16. That is, in this fourth high pressure introduction groove 65, fourth seal width S4 which is a seal width between mounting raised portion 13 and cam ring 16 on the inner circumference side of (in a region radially inside) fourth high pressure introduction groove 65 is largely ensured within a region in which fourth high pressure introduction groove 65 is not deviated from a region of radial width W0 of cam ring 16 within the region of the swing movement of cam ring 16.

From the fourth condition, fourth high pressure introduction groove 65 is formed so that an extension position of an end of fourth high pressure introduction groove 65 is positioned nearer to the rotational start end of second discharge port 39 in the rotational direction of rotor 21 than to the rotational terminal end of first suction port 25 in the rotational direction of rotor 21. That is, fourth high pressure introduction groove 65 is formed so that the end of fourth high pressure introduction groove 65 is positioned at a substantially central position of the circumferential region of second closed portion CL2.

Second pressure introduction groove 66 has a narrow shape, like high pressure introduction grooves 64 and 65. Second pressure introduction groove 66 includes an introduction portion 66*a* which is shaped like a spherical recessed portion, which is always opened to first fluid pressure chamber P1 within the region of the swing movement of cam ring 16, and which is arranged to introduce the control pressure within first fluid pressure chamber P1 to pressure introduction groove 66; a radial extension portion 66*b* extending from introduction portion 66*a* toward the inner circumference side of mounting raised portion 13 in the radially inward direction; and a circumferential extension portion 66*c* extending from the end of radial extension portion 66*b* toward first suction pressure introduction port 34 to a portion near first suction pressure introduction port 34. Pressure introduction groove 66 serves for lubricating a portion between the end surface of mounting raised portion 13 and the second side surface 16*c* of cam ring 16 on the outer circumferential region on the rotational terminal end side (in a region radially outside the terminal end portion) of first suction port 25 in the rotational direction of rotor 21.

Introduction grooves 64-66 have, respectively, constant radial widths W4-W6 in the cross sections in groove depth direction, like introduction grooves 61-63. That is, introduction grooves 64-66 have rectangular cross sections, respectively. With this, it is possible to ensure large flow passage areas of introduction grooves 64-66. Introduction grooves 64-66 serve for effectively lubricating the portion between cam ring 16 and mounting raised portion 13.

Hereinafter, effects of variable displacement vane pump 1 according to the first embodiment of the present invention are illustrated below with reference to FIGS. 1, 3 and 4.

In variable displacement vane pump 1 according to the first embodiment, first housing 11 and second housing 12 are tightened by the bolts on the outer circumference side of first housing 11 and second housing 12, as described above. The discharge pressure within back pressure ports 54 and 55 and second discharge port 39 are acted to mounting raised portion 13. On the other hand, the only outer circumference portion of pressure plate 23 is supported by adapter ring 15. Moreover, the discharge pressure is acted to the most part (large part) of the second side surface 23*b* of pressure plate 23. Accordingly, pressure plate 23 is deformed (changes the shape thereof) so as to be raised to the second housing 12's side. Mounting raised portion 13 is deformed (changes the shape thereof) so as to be recessed. In this case, a center portion of pressure plate 23 and a center portion of mounting raised portion 13 are not supported. Therefore, the deformation (shape change) of pressure plate 23 and the deformation (shape change) of mounting raised portion 13 increase toward the center portion of pressure plate 23 and the center portion of mounting raised portion 13. That is, pressure plate 23 is deformed so that first side surface 23*a* is opened to the outside. That is, the circumferential groove formed in one side surface 23*a* is deformed to be opened to the outer circumference side. On the other hand, mounting raised portion 13 is deformed so that the end surface is closed to the inside. The circumferential groove formed in the end surface changes the shape to be opened to the inner circumference side.

However, in pump 1 according to the first embodiment, first high pressure introduction groove 61 of pressure plate 23 on the first fluid pressure chamber P1's side includes circumferential extension portion 61*b* disposed near the inner circumference side. With this, first seal width SL1 on the outer circumference side of first high pressure introduction groove 61 can have large width. Accordingly, it is possible to suppress (minimize) the opening degree of high pressure introduction groove 61 to the outer circumference side by first seal width SL1 with the large width even when first side surface 23*a* of pressure plate 23 is deformed so as to be opened to the outer circumference side by the discharge pressure. Therefore, it is possible to suppress the leakage of the hydraulic fluid on the outer circumference side of high pressure introduction groove 61.

Second high pressure introduction groove 62 of pressure plate 23 on the second fluid pressure chamber P2's side is provided at a radial position radially outside first high pressure introduction groove 61. However, second seal width SL2 on the outer circumference side of second high pressure introduction groove 62 has the large width, like first high pressure introduction groove 61. With this, it is possible to suppress (minimize) the opening degree of high pressure introduction groove 62 to the outer circumference side by second seal width SL2 with the large width even when the first side surface 23*a* of pressure plate 23 is deformed so as to be opened to the outer circumference side by the discharge pressure. Therefore, it is possible to suppress the leakage of the hydraulic fluid on the outer circumference side of high pressure introduction groove 62.

Third high pressure introduction groove 64 of mounting raised portion 13 on the first fluid pressure chamber P1's side is disposed at a radial position radially outside first high pressure introduction groove 61. With this, third seal width SL3 on the inner circumference side of third high pressure introduction groove 64 has the large width. Accordingly, it is possible to suppress (minimize) the opening degree of high pressure introduction groove 64 to the inner circumference side by third seal width SL3 with the large width even when the end surface of mounting raised portion 13 is deformed by the discharge pressure so as to be closed to the inside. Therefore, it is possible to suppress the leakage of the hydraulic fluid on the inner circumference side of high pressure introduction groove 64.

Fourth high pressure introduction groove 65 of mounting raised portion 13 on the second fluid pressure chamber P2's side is disposed at a radial position which is radially outside second high pressure introduction groove 62, and which is radially outside third high pressure introduction groove 64. With this, fourth seal width SL4 on the inner circumference side of fourth high pressure introduction groove 65 has the large width. Accordingly, it is possible to suppress (minimize) the opening degree to the inner circumference side of high pressure introduction groove 64 by fourth seal width SL4 with the large width even when the end surface of mounting raised portion 13 is deformed by the discharge pressure so as to be closed to the inside. Therefore, it is possible to suppress the leakage of the hydraulic fluid on the inner circumference side of high pressure introduction groove 65.

Moreover, the discharge pressure is introduced into high pressure introduction grooves 61, 62, 64 and 65. With this, it is possible to suppress the deformation of pressure plate 23 and the deformation of mounting raised portion 13. Accordingly, it is possible to effectively suppress the leakage of the hydraulic pressure in high pressure introduction grooves 61, 62, 64 and 65.

The bias positions (arrangements) of high pressure introduction grooves 61, 62, 64 and 65 are set within a region in which high pressure introduction grooves 61, 62, 64 and 65 are not deviated from the radial region of radial width W0 of cam ring 16 within the region of the swing movement of cam ring 16. With this, it is possible to prevent the hydraulic fluid from leaking from high pressure introduction grooves 61, 62, 64 and 65 directly to fluid pressure chambers P1 and P2 and pump chambers 20, irrespective of the phase of cam ring 16.

Moreover, high pressure introduction grooves 61, 62, 64 and 65 have, respectively, extension amounts that the ends of high pressure introduction grooves 61, 62, 64 and 65 are sufficiently apart from suction ports 25 and 35, and nearer to discharge ports 30 and 39 than to suction ports 25 and 35. With this, it is possible to sufficiently prevent the leakage of the hydraulic fluid from high pressure introduction grooves 61, 62, 64 and 65 to suction ports 25 and 35 which tends to be generated due to the pressure difference.

Moreover, pressure introduction grooves 63 and 66 are arranged to receive the control pressure of first fluid pressure chamber P1. The control pressure is smaller than the discharge pressure. However, the control pressure is larger than the suction pressure. Accordingly, it is possible to sufficiently lubricate the portion between pressure plate 23 or mounting raised portion 13, and cam ring 16.

Furthermore, these pressure introduction grooves 63 and 66 are arranged to receive the control pressure within first fluid pressure chamber P1. With this, the pressure difference between the control pressure within these pressure introduction grooves 63 and 66 and the suction pressure becomes small. Accordingly, it is possible to suppress the leakage of the hydraulic fluid from introduction grooves 63 and 66 to suction ports 25 and 35 even when introduction grooves 63 and 66 are disposed near suction ports 25 and 35.

Pressure introduction grooves 63 and 66 do not employ special bias positions, unlike high pressure introduction grooves 61, 62, 64 and 65. However, it is effective that pressure introduction grooves 63 and 66 employ the bias positions like high pressure introduction grooves 61, 62, 64 and 65. With this, it is possible to attain the effects identical to these of high pressure introduction grooves 61, 62, 64 and 65, that is, to suppress the leakage of the hydraulic fluid in introduction grooves 63 and 66 by the deformation of pressure plate 23 and the deformation of mounting raised portion 13 by the discharge pressure.

Figure 5:
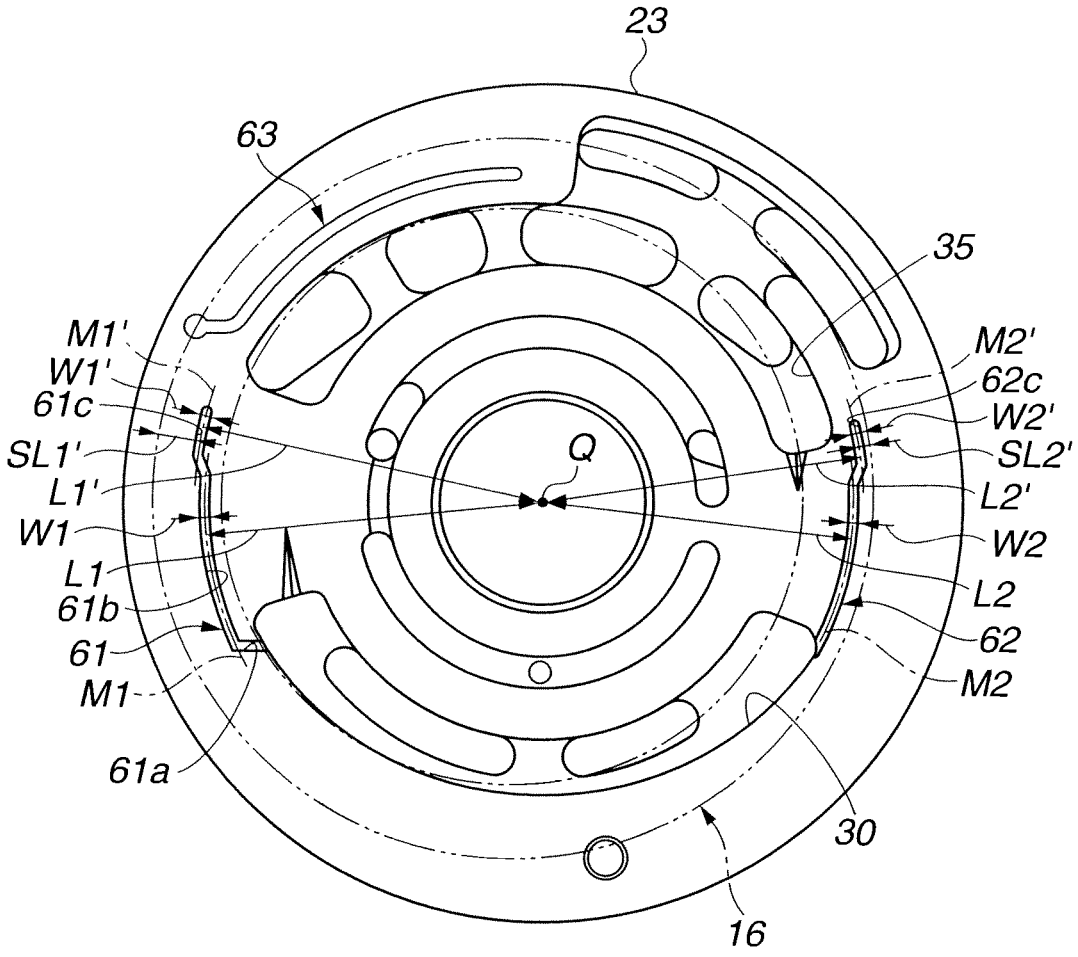
FIG. 5 is a view which is for illustrating a main part of a variable displacement vane pump according to a first variation of the first embodiment of the present invention, and in which the pressure plate shown in FIG. 1 is viewed from the cam ring side.

FIG. 5 shows a first variation according to the first embodiment. In this first variation according to the first embodiment, high pressure introduction grooves 61 and 62 are extended (elongated) toward suction ports 25 and 35.

That is, this first high pressure introduction groove 61 further extends in the circumferential direction relative to first high pressure introduction groove 61 of the first embodiment. The end of first high pressure introduction groove 61 extends (elongates) to a portion near the terminal end of second suction port 35 in the rotational direction of rotor 21.

This first high pressure introduction groove 61 extends so that a radial length L1' between a center M1' of a radial width W1' of a tip end portion located near the rotational terminal end of second suction port 35 in the rotational direction of rotor 21, and a rotation center Q of rotor 21 is larger than a radial distance between a center M1 of a radial width W1 of a base end portion located near the rotational start end of first discharge port 30 in the rotational direction of rotor 21, and rotation center Q of rotor 21. That is, This first high pressure introduction groove 61 includes an outer circumference side bias portion 61*c* which is located on the tip end side, and which is offset in the radially outside direction relative to the base end side.

On the other hand, second high pressure introduction groove 62 further extends (elongates) in the circumferential direction relative to second high pressure introduction groove 62 of the first embodiment, like first high pressure introduction groove 61. An end portion of second high pressure introduction groove 62 extends (elongates) to a portion near the rotational start end of second suction port 35 in the rotational direction of rotor 21.

This second high pressure introduction groove 62 extends so that a radial distance L2' between a center M2' of a radial width W2' of the tip end portion located near the start end of second suction port 35 in the rotational direction of rotor 21, and the rotation center Q of rotor 21 is larger than a radial distance between a center M2 of a radial width W2 of the base end portion located near the rotational terminal end of first discharge port 30 in the rotational direction of rotor 21, and the rotation center Q of rotor 21. That is, second high pressure introduction groove 62 includes an outer circumference side bias portion 62*c* which is located on the tip end side, and which is offset in the radially outward direction relative to the base end side.

In this first variation, outer circumference side bias portions 61*c*, 62*c* are provided at tip end sides of high pressure introduction grooves 61 and 62. With this, it is possible to ensure larger seal widths SL1' and SL2' which are on the inner circumference side of outer circumference side bias portions 61*c* and 62*c*, and which are on the tip end side. Accordingly, it is possible to further suppress the leakage of the hydraulic fluid by the deformation of pressure plate by the discharge pressure.

Moreover, it is possible to ensure a large distance with respect to second suction port 35 which tends to cause the leakage of the hydraulic fluid due to the large pressure difference by providing outer circumference side bias portions 61*c* and 62*c* at the tip end sides of high pressure introduction grooves 61 and 62. Therefore, it is possible to effectively suppress the leakage of the hydraulic fluid from high pressure introduction grooves 61 and 62 to second suction port 35.

Figure 6:
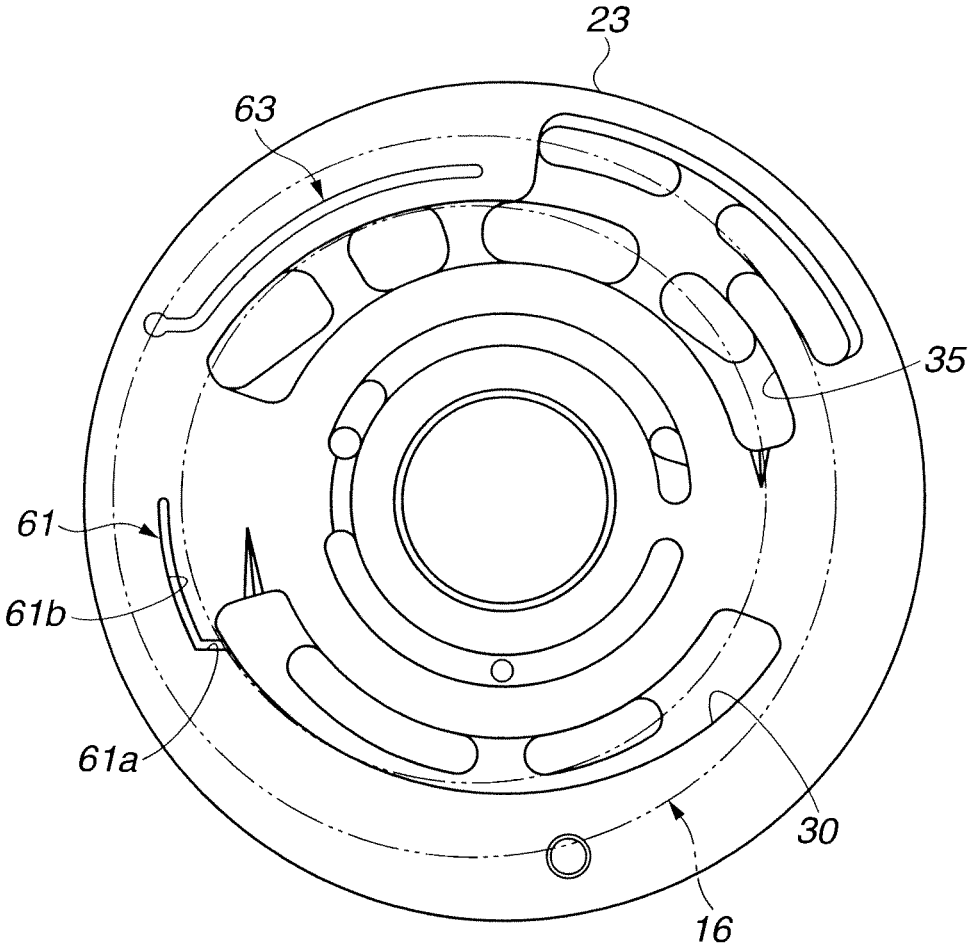
FIG. 6 is a view which is for illustrating a main part of a variable displacement vane pump according to a second variation of the first embodiment of the present invention, and in which the pressure plate shown in FIG. 1 is viewed from the cam ring side.
Figure 7:
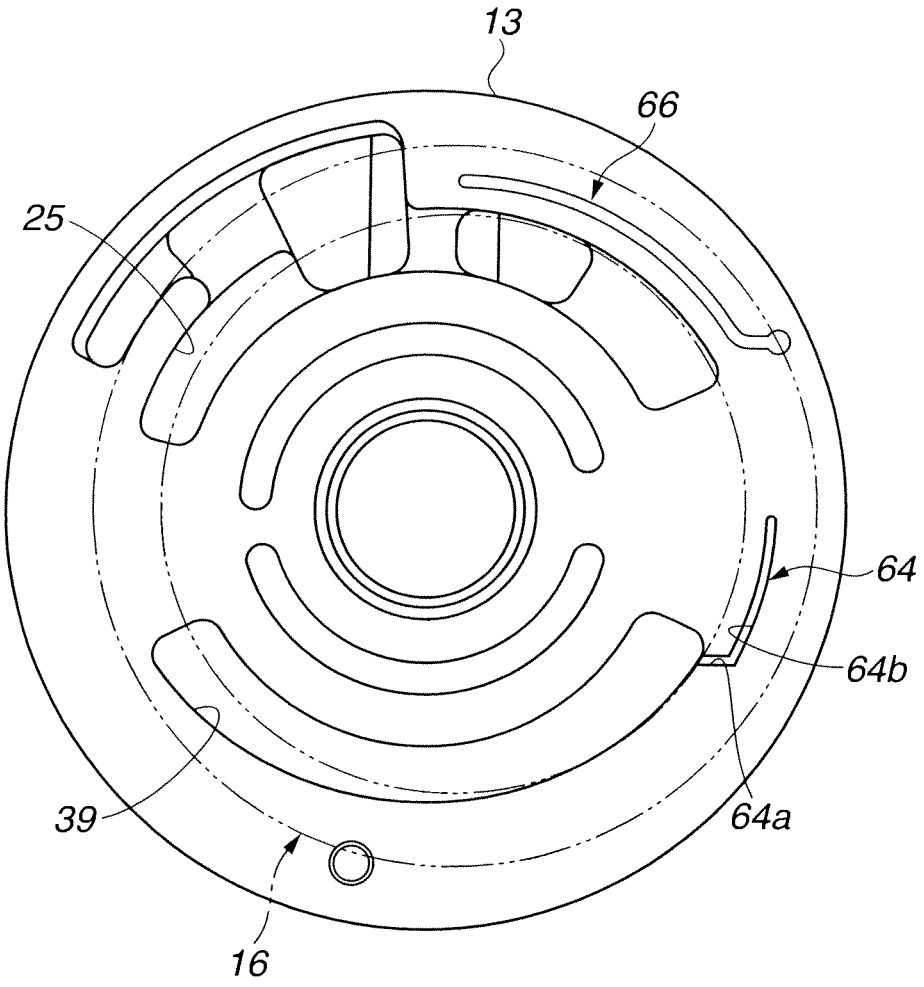
FIG. 7 is a view which is for illustrating a main part of the variable displacement vane pump according to the second variation of the first embodiment of the present invention, and in which the second housing shown in FIG. 1 is viewed from the cam ring side.

FIGS. 6 and 7 show a second variation according to the first embodiment. High pressure introduction grooves 62 and 65 are omitted from the structure of the first embodiment.

That is, high pressure introduction grooves 62 and 65 have the suction pressure by constantly connecting second fluid pressure chamber P2 to suction ports 25 and 35. With this, the pressure difference between the suction pressure and the discharge pressure is large. In high pressure introduction grooves 62 and 65, the leakage of the hydraulic fluid tends to generate relative to high pressure introduction grooves 61 and 64.

In this second variation, second and fourth high pressure introduction grooves 62 and 65 are omitted. Accordingly, it is possible to suppress the leakage of the hydraulic fluid to the second fluid pressure chamber P2's side which tends to generate due to the pressure difference.

Figure 8:
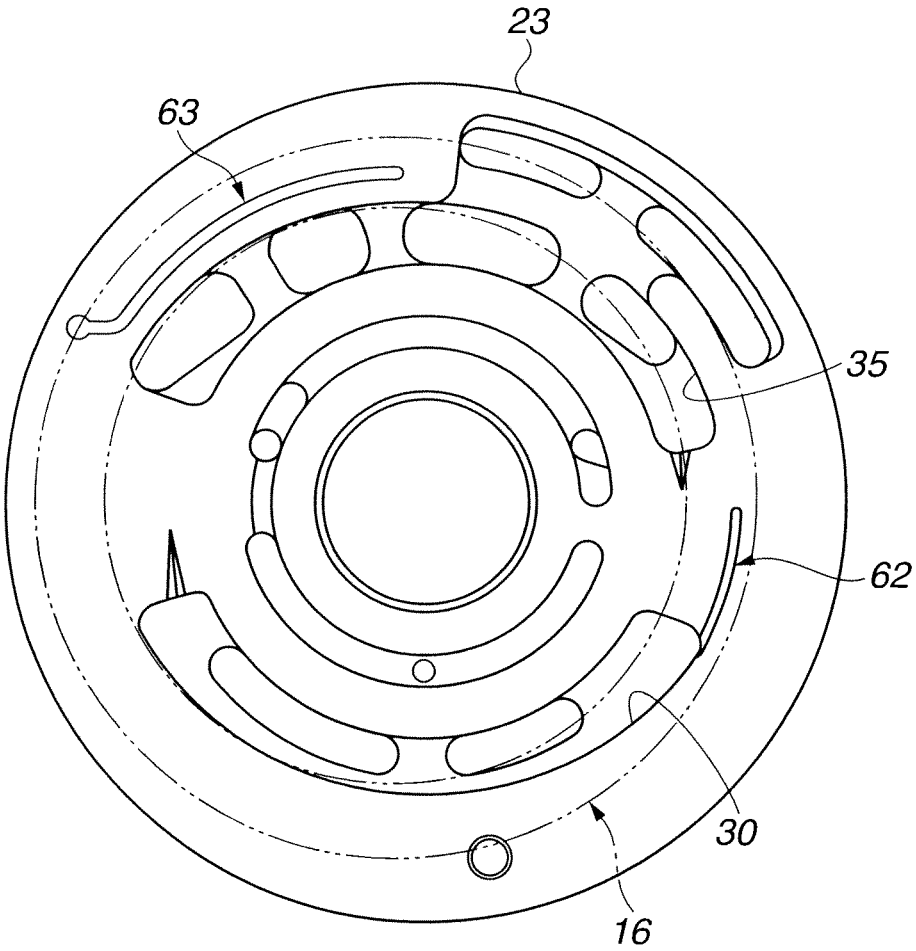
FIG. 8 is a view which is for illustrating a main part of a variable displacement vane pump according to a third variation of the first embodiment of the present invention, and in which the pressure plate shown in FIG. 1 is viewed from the cam ring side.
Figure 9:
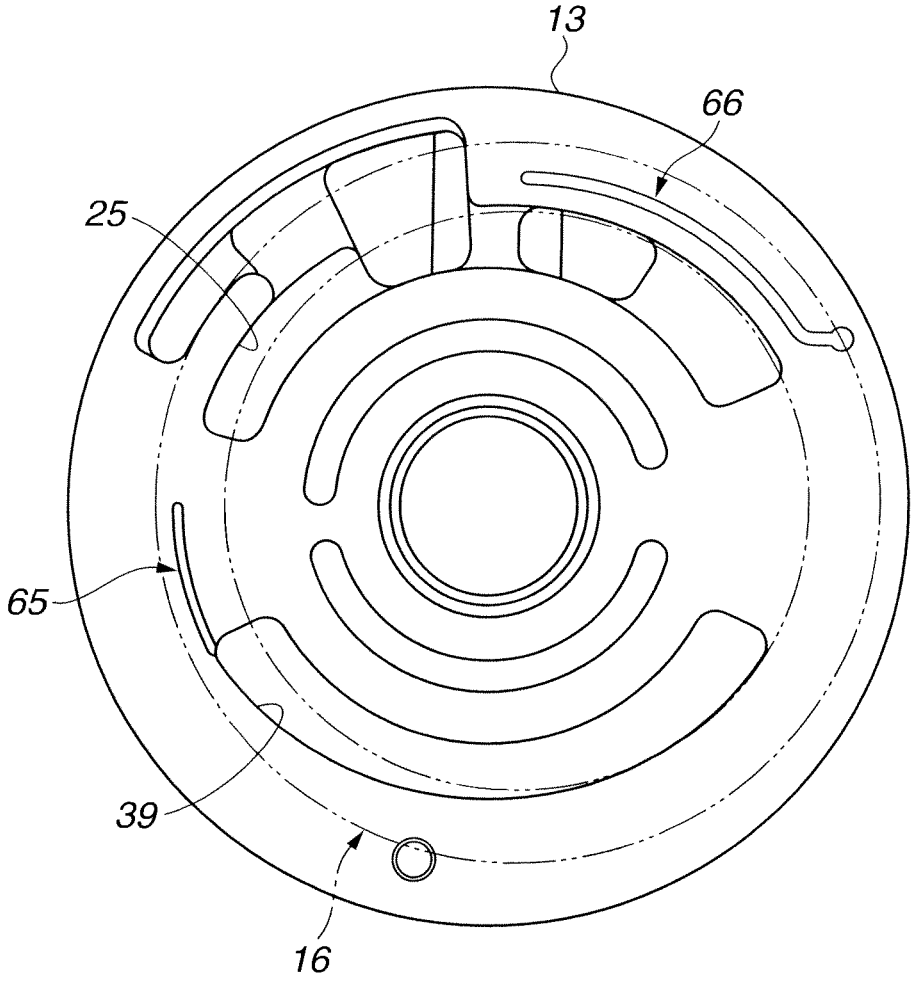
FIG. 9 is a view which is for illustrating a main part of the variable displacement vane pump according to the third variation of the first embodiment of the present invention, and in which the second housing shown in FIG. 1 is viewed from the cam ring side.

FIGS. 8 and 9 show a third variation according to the first embodiment. The high pressure introduction grooves 61 and 64 are omitted from the structure of the first embodiment.

Pump 1 is arranged to control the swing movement of cam ring 16 by the internal pressure of first fluid pressure chamber P1. First fluid pressure chamber P1 is basically in a closed state, unlike second fluid pressure chamber P2 (that is, the hydraulic fluid does not flow into and out of first fluid pressure chamber P1). When the leakage from high pressure introduction grooves 61 and 64 to the first fluid pressure chamber P1's side is generated, the control of the swing movement of cam ring 16 may be adversely affected by largely varying the internal pressure of first fluid pressure chamber P1.

In this third variation, high pressure introduction grooves 61 and 64 located on the first pressure chamber P1's side are omitted. With this, it is possible to suppress (minimize) the leakage of the discharge pressure to the first fluid pressure chamber P1's side. Therefore, it is possible to suppress the deterioration of the controllability of cam ring 16 which is caused by the leakage.

As mentioned in the second variation, the leakage of the hydraulic fluid tends to generate on the second fluid pressure chamber P2's side, relative to the first fluid pressure chamber P1's side. However, second fluid pressure chamber P2 is constantly connected to suction ports 25 and 35. Accordingly, it is possible to prevent the deterioration of the controllability of cam ring 16 even when the discharge pressure is leaked to the second fluid pressure chamber P2's side.

Figure 10:
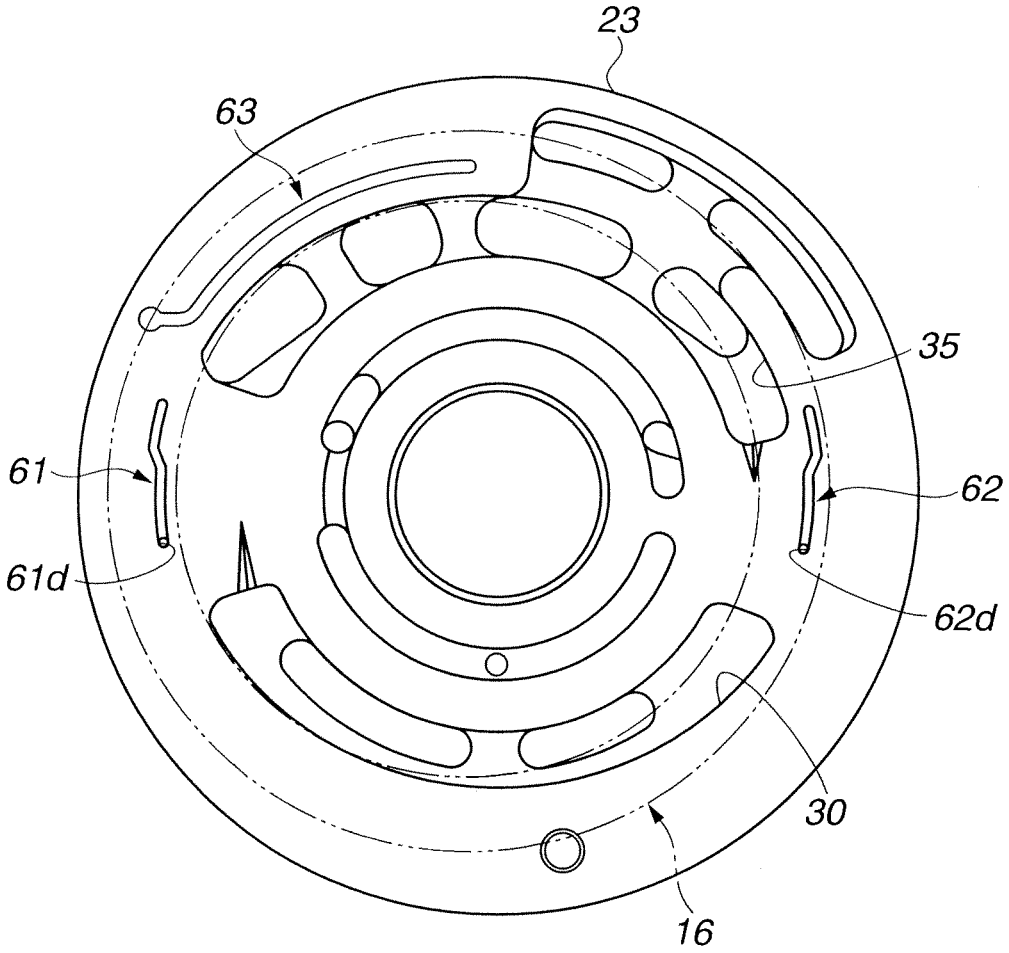
FIG. 10 is a view which is for illustrating a main part of a variable displacement vane pump according to a fourth variation of the first embodiment of the present invention, and in which the pressure plate shown in FIG. 1 is viewed from the cam ring side.
Figure 11:
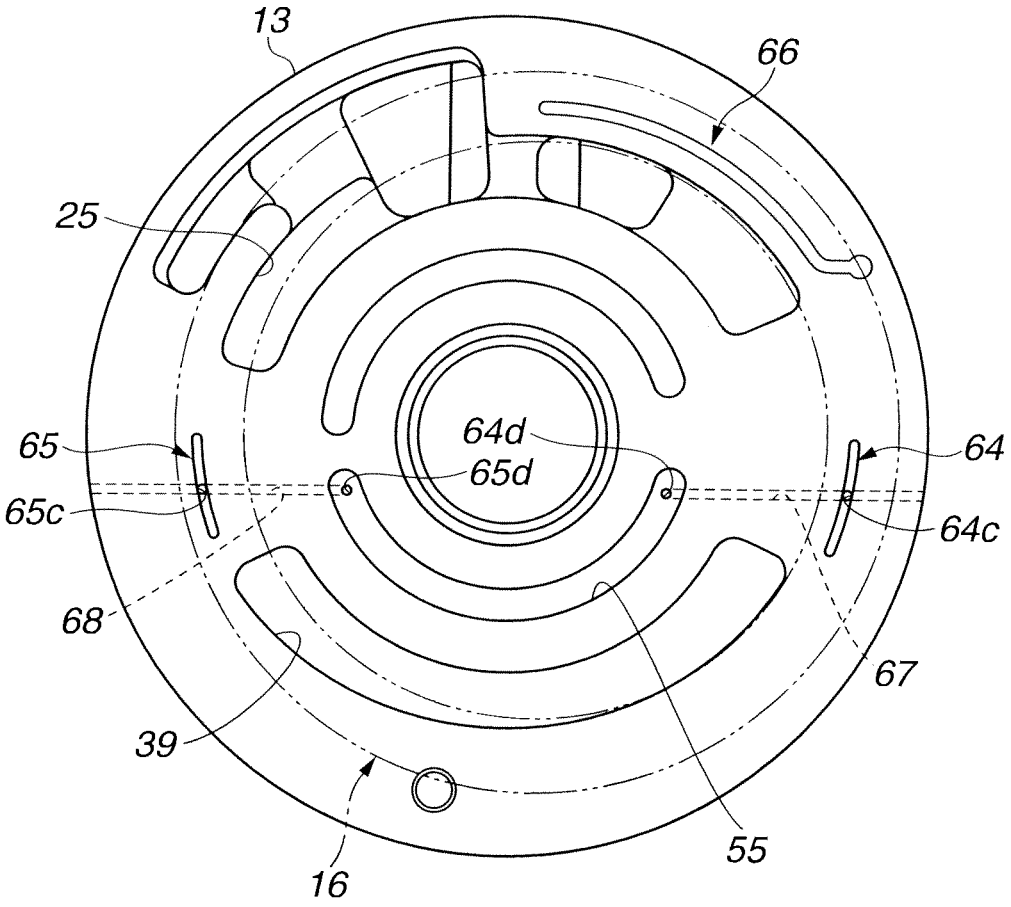
FIG. 11 is a view which is for illustrating a main part of the variable displacement vane pump according to the forth variation of the first embodiment of the present invention, and in which the second housing shown in FIG. 1 is viewed from the cam ring side.

FIGS. 10 and 11 show a variable displacement vane pump according to a fourth variation of the first embodiment. The variable displacement vane pump according to the fourth variation has a structure substantially identical to the variable displacement vane pump according to the first embodiment. In the variable displacement vane pump according to the fourth variation, introduction paths of the discharge pressure of high pressure introduction grooves 61, 62, 64 and 65 are changed from the structure of the variable displacement vane pump according to the first embodiment.

In variable displacement vane pump 1 according to the fourth variation, the discharge pressure is introduced to first and second high pressure introduction grooves 61 and 62 from the high pressure region formed on the second side surface 23*b*'s side of pressure plate 23, instead of first discharge port 30. As shown in FIG. 10, high pressure introduction grooves 61 and 62 include, respectively, introduction holes 61*d* and 62*d* which are located on base end portions of high pressure introduction grooves 61 and 62, which penetrate in the axial direction, and which connect high pressure introduction grooves 61 and 62 and the high pressure regions located on the back surface sides of high pressure introduction grooves 61 and 62 (pressure plate 23). The discharge pressure is introduced through introduction holes 61*d* and 62*d* to introduction grooves 61 and 62. Accordingly, in the thus-constructed variable displacement vane pump according to the fourth variation, it is possible to attain the effects identical to the variable displacement vane pump according to the second variation.

On the other hand, the discharge pressure is introduced to third and fourth introduction grooves 64 and 65 from the ends of second discharge side back pressure port 55, instead of second discharge port 39. As shown in FIG. 11, high pressure introduction grooves 64 and 65 include, respectively, introduction holes 64*c* and 65*c* which are located at central portions of the circumferential direction, and which extend in the axial direction. Moreover, second discharge side back pressure port 55 includes discharge holes 64*d* and 65*d* located on both end portions of second discharge side back pressure port 55. These introduction holes 64*c* and 65*c* and discharge holes 64*d* and 65*d* are connected, respectively, with each other by connection passages 67 and 68 formed within mounting raised portion 13. In third high pressure introduction groove 64, the hydraulic fluid of the discharge pressure within second discharge side back pressure port 55 is discharged through discharge hole 64*d* to the connection passage 67 on the back surface side. Then, the hydraulic fluid is introduced from connection passage 67 through introduction hole 64*c* to third high pressure introduction groove 64. Similarly, in the fourth high pressure introduction groove 65, the hydraulic fluid of the discharge pressure within second discharge side back pressure port 55 is discharged through discharge hole 65*d* to connection passage 68 on the back surface side. Then, the hydraulic fluid is introduced from connection passage 68 through introduction hole 65*c* to fourth high pressure introduction groove 65. Accordingly, in the thus-constructed variable displacement vane pump according to the fourth variation, it is possible to attain the effects identical to the first embodiment.

Figure 12:
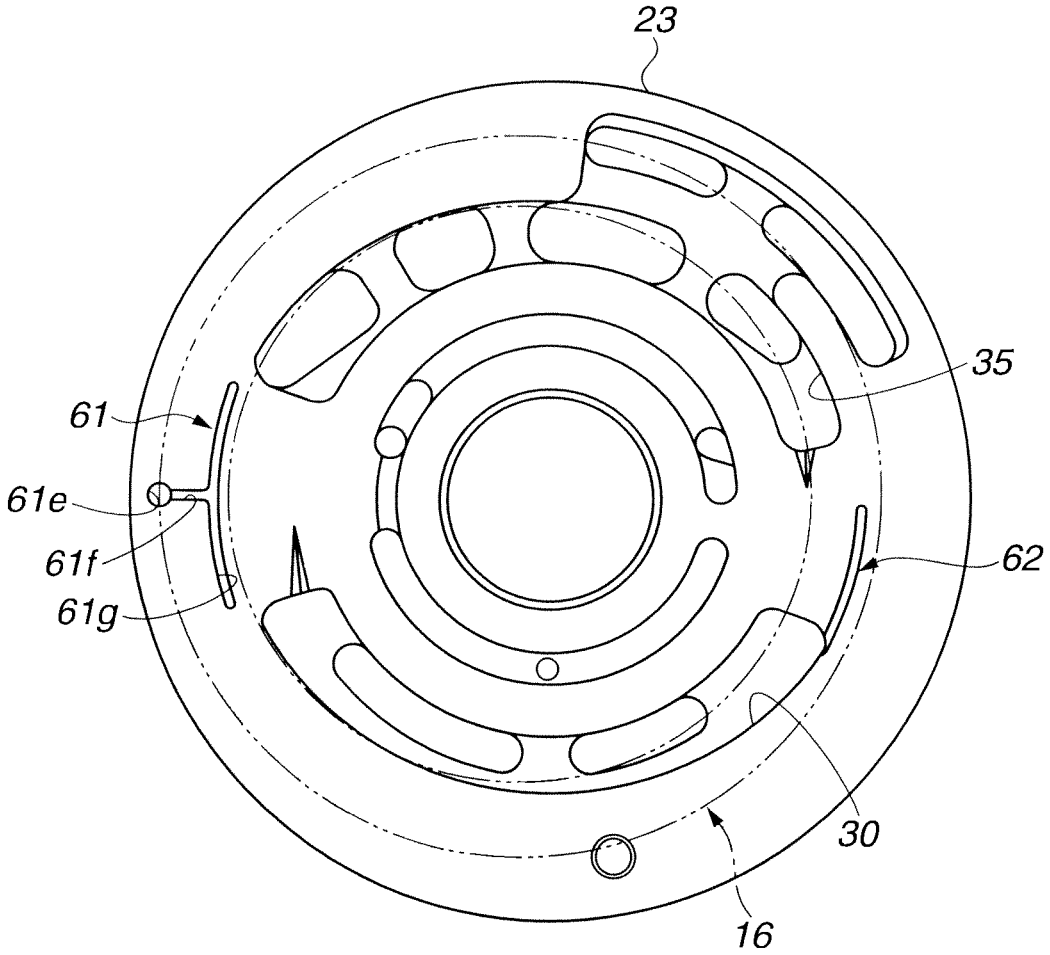
FIG. 12 is a view which is for illustrating a main part of a variable displacement vane pump according to a second embodiment of the present invention, and in which the pressure plate shown in FIG. 1 is viewed from the cam ring side.
Figure 13:
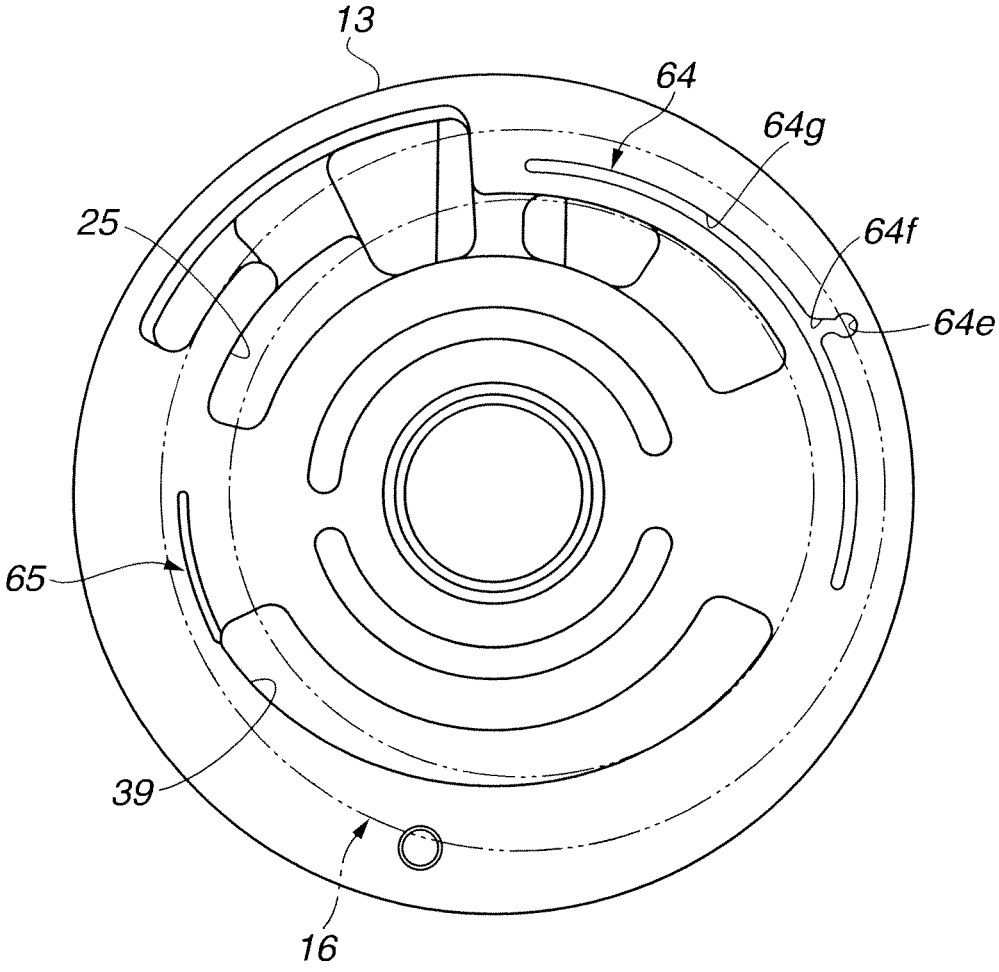
FIG. 13 is a view which is for illustrating a main part of the variable displacement vane pump according to the second embodiment of the present invention, and in which the second housing shown in FIG. 1 is viewed from the cam ring side.

FIGS. 12 and 13 show a variable displacement vane pump according to a second embodiment of the present invention. Variable displacement vane pump according to the second embodiment has a structure substantially identical to the structure of the variable displacement vane pump according to the first embodiment. In the variable displacement vane pump according to the second embodiment, the structure of the first and third high pressure introduction grooves 61 and 64 are varied from the structure of the first embodiment.

That is, in variable displacement vane pump 1, the control pressure is introduced from first fluid pressure chamber P1 to first and third high pressure introduction grooves 61 and 64, instead of the discharge pressure from first discharge port 30.

First high pressure introduction groove 61 includes an introduction portion 61*e* which is shaped like a spherical recessed shape, and whose a part confronts first fluid pressure chamber P1 in the maximum eccentric state of cam ring 16, a radial extension portion 61*f* extending in the radially inward direction from introduction portion 61*e*, and a circumferential extension portion 61*g* which extends in a bifurcated shape in the circumferential direction from the end of radial extension portion 61*f* to the second suction port 35's side and the first discharge port 30's side, and which is formed all over around the circumferential region of first closed portion CL1. Circumferential extension portion 61*g* is formed to satisfy the two conditions of circumferential extension portion 61*b* of first high pressure introduction groove 61 of the first embodiment.

On the other hand, like first high pressure introduction groove 61, third high pressure introduction groove 64 includes an introduction portion 64*e* which is shaped like a spherical recessed shape, and whose a part confronts first fluid pressure chamber P1 in the maximum eccentric state of cam ring 16, a radial extension portion 64*f* extending in the radially inward direction from introduction portion 64*e*, and a circumferential extension portion 64*g* which extends in a bifurcated shape in the circumferential direction from the end of radial extension portion 64*f* to the first suction port 25's side and the second discharge port 39's side, and which is formed in a circumferential region from the rotational terminal end of the first suction port 25 in the rotational direction of rotor 21 to a portion near the rotational start end of second discharge port 39 in the rotational direction of rotor 21. Circumferential extension portion 64*g* is formed to satisfy the four conditions of circumferential extension portion 64*b* of third high pressure introduction groove 64 of the first embodiment.

Accordingly, in the variable displacement vane pump according to the second embodiment, first and third high pressure introduction grooves 61 and 64 are arranged to receive the control pressure which is smaller than the discharge pressure, and which is larger than the suction pressure. With this, it is possible to sufficiently lubricate at the swing movement of cam ring 16, and to effectively suppress the leakage of the hydraulic fluid to the outer circumference sides of high pressure introduction grooves 61 and 64 from the high pressure introduction grooves 61 and 64 by eliminating the pressure differences between first and third high pressure introduction grooves 61 and 64 and first fluid pressure chamber P1.

Moreover, the control pressure is sufficiently smaller than the discharge pressure. Accordingly, by the thus-constructed variable displacement vane pump, the pressure difference between first and third high pressure introduction grooves 61 and 64, and suction ports 25 and 35 or pump chambers 20 becomes small. Accordingly, it is possible to effectively suppress the leakage of the hydraulic fluid to the inner circumference side of high pressure introduction grooves 61 and 64 from high pressure introduction grooves 61 and 64.

Moreover, high pressure introduction grooves 61 and 64 are arranged to receive the control pressure for the control of the swing movement of cam ring 16. Accordingly, there is no need to generate a new (special) pressure by using the exist pressure. Therefore, it is possible to attain the preferable lubricating function at the movement of the cam ring without complicating the structure of pump 1.

Figure 14:
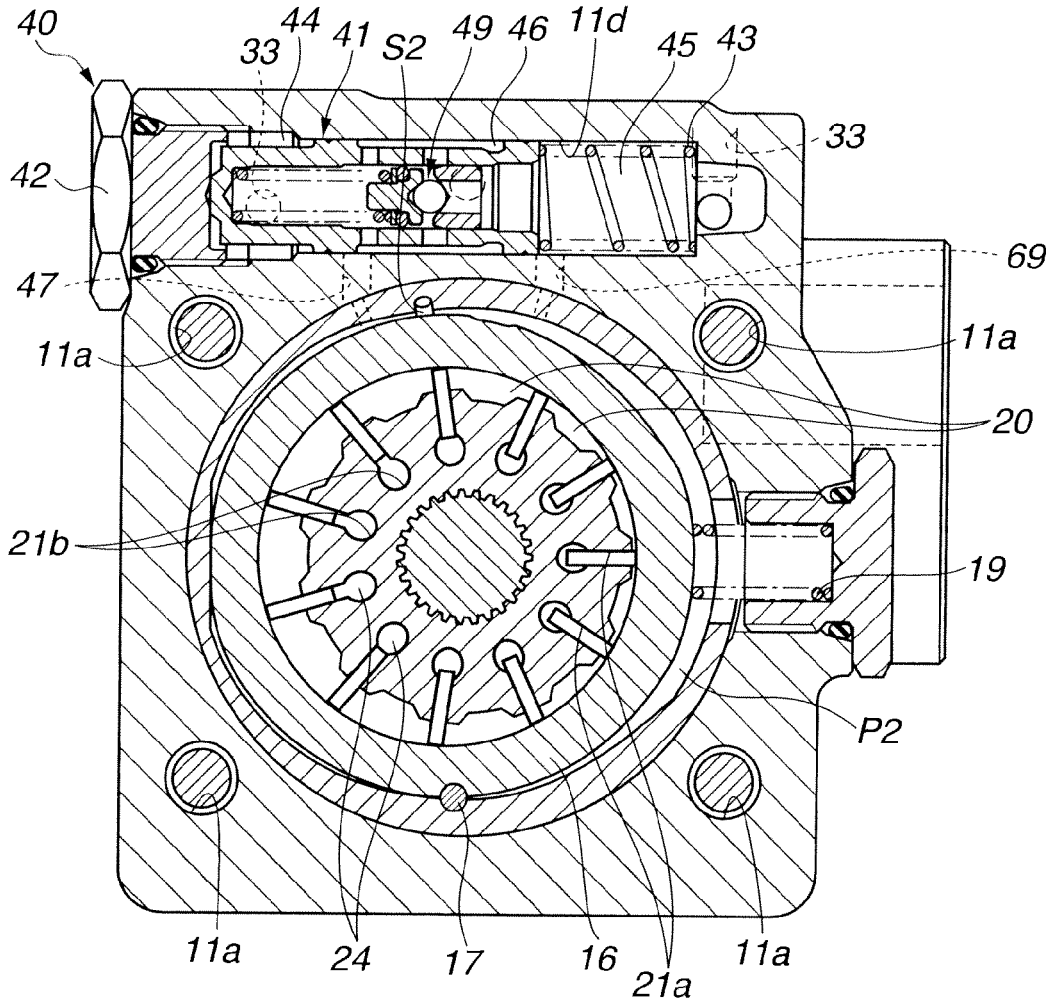
FIG. 14 is a sectional view which shows a variable displacement vane pump according to a third embodiment of the present invention, and which is taken along a section line A-A of FIG. 1.
Figure 15:
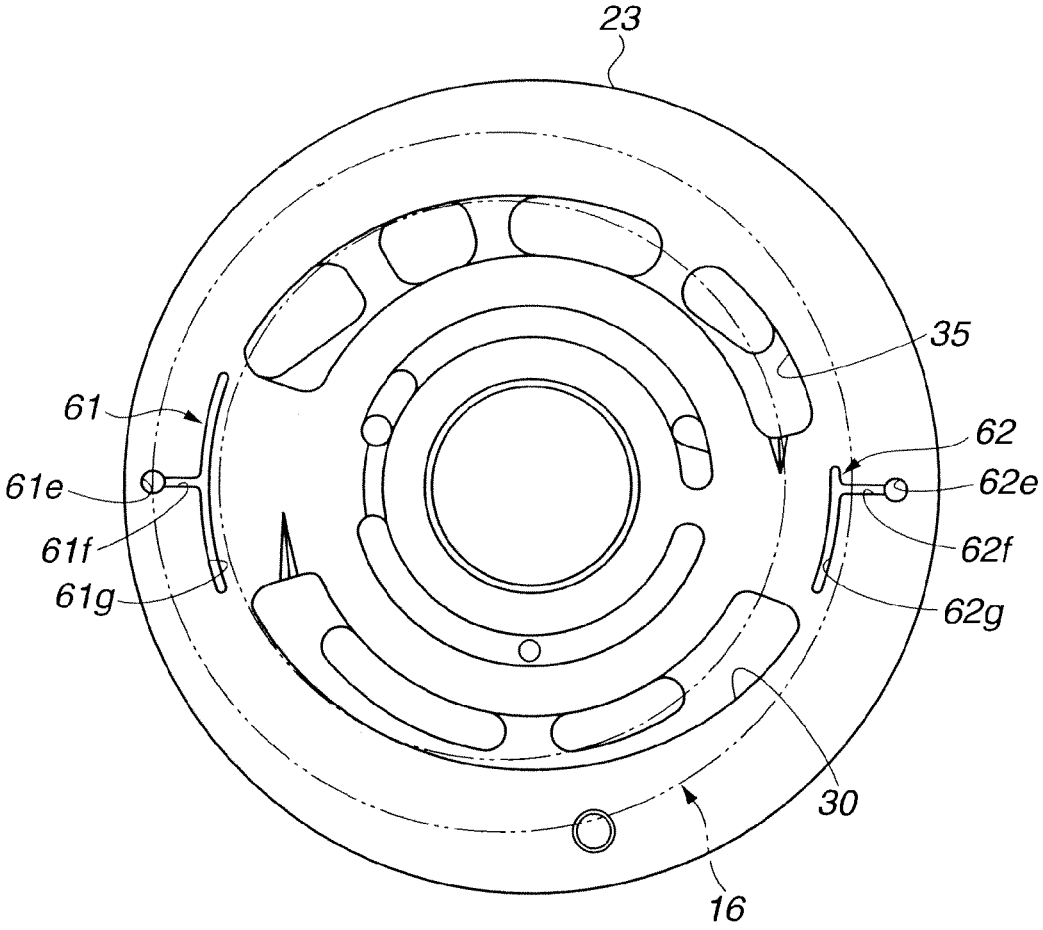
FIG. 15 is a view which is for illustrating a main part of the variable displacement vane pump according to the third embodiment of the present invention, and in which a pressure plate shown in FIG. 14 is viewed from the cam ring side.
Figure 16:
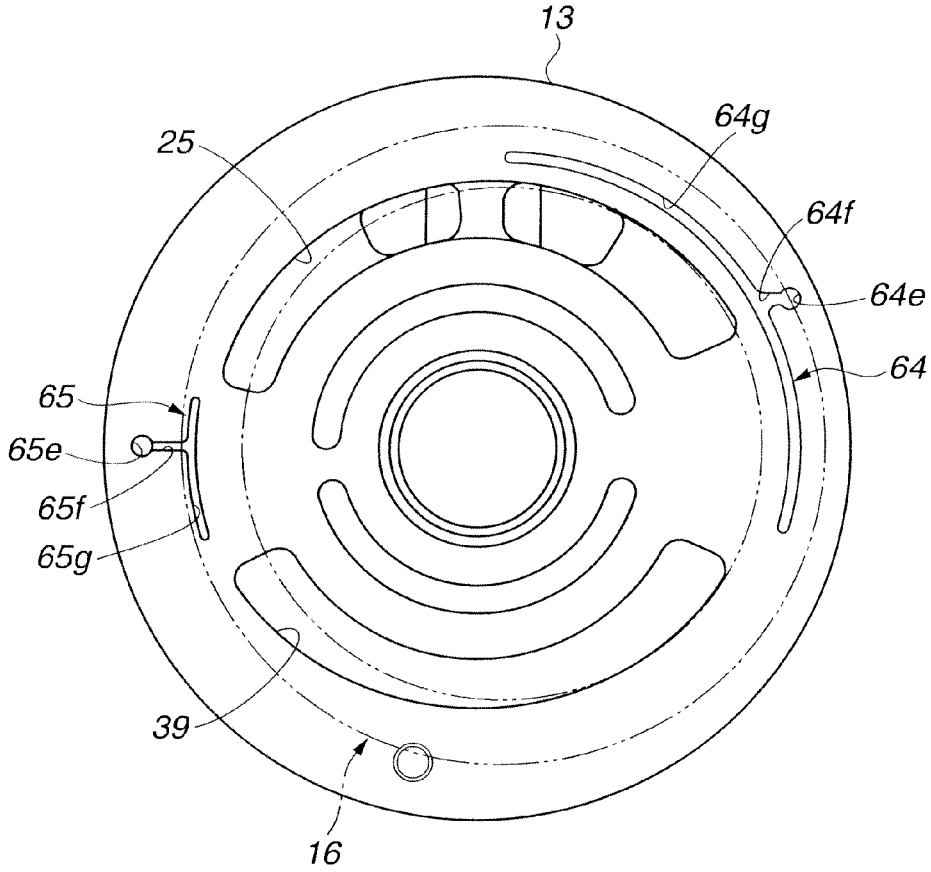
FIG. 16 is a view which is for illustrating a main part of the variable displacement vane pump according to the third embodiment of the present invention, and in which a second housing shown in FIG. 14 is viewed from the cam ring side.

FIGS. 14-16 show a variable displacement vane pump according to a third embodiment of the present invention. The variable displacement vane pump according to the third embodiment has a structure substantially identical to the structure of the variable displacement vane pump according to the second embodiment. In the variable displacement vane pump according to the third embodiment, the structures of second and fourth high pressure introduction grooves 62 and 65 are varied from the structures of the second embodiment.

As shown in FIG. 14, variable displacement vane pump 1 according to the third embodiment includes a continuous connection passage 69 which is formed on a circumferential wall of valve hole 11*d* of first housing 11 and adapter ring 15, and which connects middle pressure chamber 45 of control valve 40 and second fluid pressure chamber P2. Connection passage 69 is arranged to introduce, to second fluid pressure chamber P2, the pressure of middle pressure chamber 45 of control valve 40, that is, a pressure (hereinafter, referred to as a middle pressure) on the downstream side of the metering orifice. Moreover, as shown in FIGS. 15 and 16, the middle pressure is introduced from second fluid pressure chamber P2 to the second and fourth high pressure introduction grooves 62 and 65, instead of from first discharge port 30.

Second high pressure introduction groove 62 includes an introduction portion 62*e* which is shaped like a spherical recessed shape, and whose a part confronts second fluid pressure chamber P2 in the minimum eccentric state of cam ring 16, a radial extension portion 62*f* extending in the radially inward direction from introduction portion 62*e*, and a circumferential extension portion 62*g* which extends in the bifurcated shape in the circumferential direction from the end of radial extension portion 62*f* to the second suction port 35's side and the first discharge port 30's side, and which is formed all over around the circumferential region of second closed portion CL2. Circumferential extension portion 62*g* is formed to satisfy the three conditions of circumferential extension portion 62*b* of second high pressure introduction groove 62 of the first embodiment.

Like second high pressure introduction groove 62, fourth high pressure introduction groove 65 includes an introduction portion 65*e* which is shaped like a spherical recessed shape, and whose a part confronts second fluid pressure chamber P2 in the minimum eccentric state of cam ring 16, a radial extension portion 65*f* extending in the radially inward direction from introduction portion 65*e*, and a circumferential extension portion 65*g* which extends in a bifurcated shape in the circumferential direction from the end of radial extension portion 65*f* to the first suction port 25's side and the second discharge port 39's side, and which is formed in a circumferential region from the rotational terminal end of first suction port 25 in the rotational direction of rotor 21 to a portion near the rotational start end of second discharge port 39 in the rotational direction of rotor 21. Circumferential extension portion 65*g* is formed to satisfy the five conditions of fourth high pressure introduction groove 65 of the first embodiment.

In this variable displacement vane pump according to the third embodiment, the second and fourth high pressure grooves 62 and 65 are arranged to receive the middle pressure which is nearer to the discharge pressure. With this, it is possible to sufficiently lubricate in the region on the second fluid pressure chamber P2's side at the swing movement of cam ring 16. Moreover, it is possible to effectively suppress the leakage of the hydraulic fluid to the outer circumference side of high pressure introduction groove 62 and 65 from high pressure introduction grooves 62 and 65 by eliminating the pressure difference between high pressure introduction grooves 62 and 65 and second fluid pressure chamber P2.

The middle pressure is slightly smaller than the discharge pressure. In the inner circumference side of high pressure introduction grooves 62 and 65, the pressure difference between pressure introduction grooves 62 and 65, and suction ports 25 and 35 or pump chambers 20 becomes slightly small. Accordingly, it is possible to suppress the leakage of the hydraulic fluid to the inner circumference side of high pressure introduction grooves 62 and 65 from high pressure introduction grooves 62 and 65.

Figure 17:
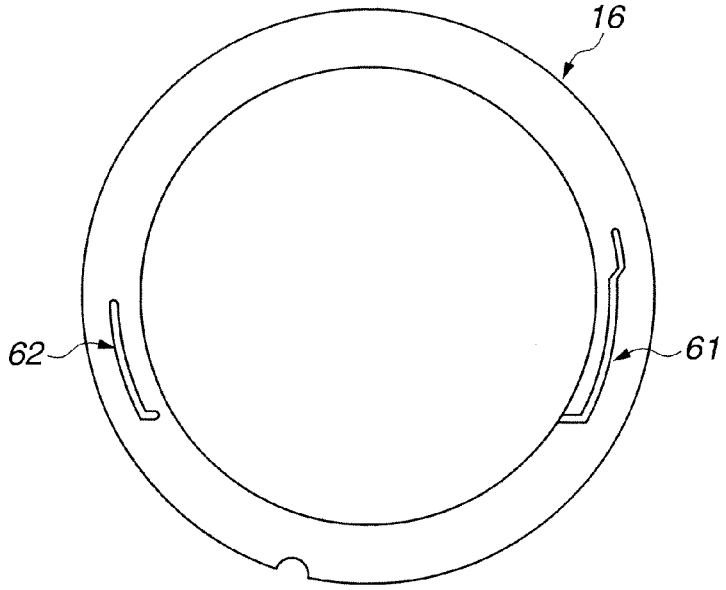
FIG. 17 is a view which is for illustrating a main part of a variable displacement vane pump according to a fourth embodiment of the present invention, and in which a cam ring shown in FIG. 1 is viewed from a pressure plate side.
Figure 18:
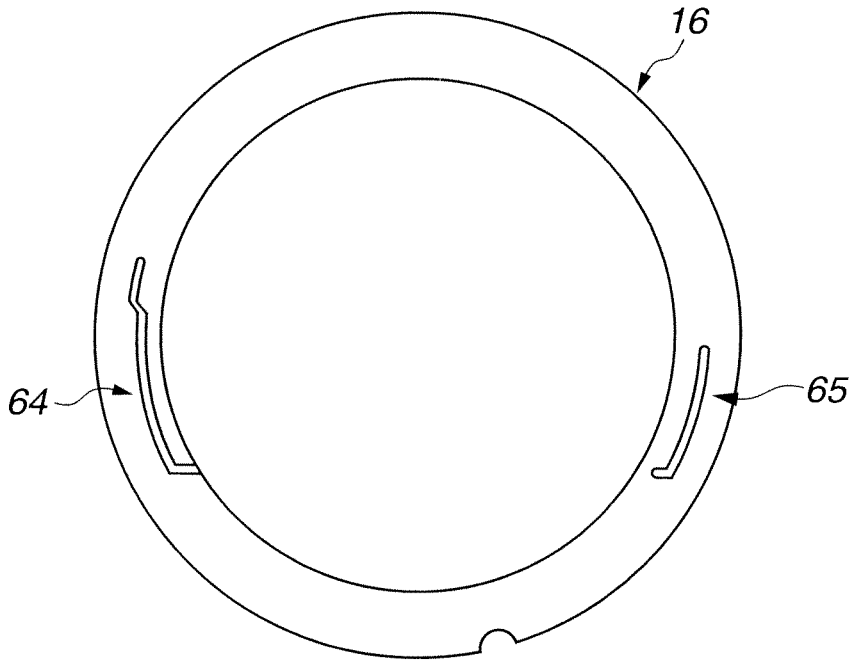
FIG. 18 is a view which is for illustrating a main part of a variable displacement vane pump according to the fourth embodiment of the present invention, and in which the cam ring shown in FIG. 1 is viewed from a second housing side.

FIGS. 17 and 18 show a variable displacement vane pump according to a fourth embodiment of the present invention. The variable displacement vane pump according to the fourth embodiment has a structure substantially identical to the structure of the first embodiment. In the variable displacement vane pump according to the fourth embodiment, first and second high pressure introduction grooves 61 and 62 are formed in first side surface 16*b* of cam ring 16 which confronts first side surface 23*a* of pressure plate 23, instead of first side surface 23*a* of pressure plate 23. Third and fourth high pressure grooves 64 and 65 are formed in the other side surface 16*c* of cam ring 16 which confronts the end surface of mounting raised portion 13, instead of the end surface of mounting raised portion 13.

In the variable displacement vane pump according to the fourth embodiment, high pressure introduction grooves 61, 62, 64 and 65 are formed in cam ring 16. With this, it is unnecessary to consider the swing movement of cam ring 16 for the arrangement of high pressure introduction grooves 61, 62, 64 and 65, unlike the first embodiment. Accordingly, it is preferable that first and second high pressure introduction grooves 61 and 62 are formed nearer to the inner circumference side. Moreover, it is preferable that third and fourth high pressure introduction grooves 64 and 65 are formed nearer to the outer circumference side.

Accordingly, in the variable displacement vane pump according to the fourth embodiment, it is unnecessary to consider the swing movement of cam ring 16 for the arrangement of high pressure introduction grooves 61, 62, 64 and 65. Consequently, it is possible to dispose high pressure introduction grooves 61, 62, 64 and 65 in radial positions which are suit for suppressing the leakage of the hydraulic fluid that is caused by the deformations of pressure plate 23 and mounting raised portion 13 by the discharge pressure. Therefore, it is possible to effectively suppress (minimize) the leakage of the hydraulic fluid at the deformations of pressure plate 23 and mounting raised portion 13 by the discharge pressure.

Moreover, it is possible to readily design high pressure introduction grooves 61, 62, 64 and 65 since it is unnecessary to consider the swing movement of cam ring 16 for the arrangement of high pressure introduction grooves 61, 62, 64 and 65. Accordingly, it is possible to decrease the design man-hour.

The present invention is not limited to the above-described embodiments. For example, it is optional to vary circumferential lengths of high pressure introduction grooves 61, 62, 64 and 65 in accordance with specifications and so on of object to which the present invention is applied.

Moreover, the above-described embodiments employ the circular adapter ring 15. However, adapter ring 15 is not limited to the circular shape as long as adapter ring 15 has an arc portion. For example, adapter ring 15 has a C-shape by cutting a part of adapter ring 15.

In the above-described embodiments, suction passage 26 is formed on the second housing 12's side. However, there is no need to form suction passage 26 on the second housing 12's side. Suction passage 26 may be formed on the first housing 11's side. Similarly, there is no need to form discharge passage 33 on the inside of first housing 11. Discharge passage 33 may be formed on the second housing 12's side.

Moreover, it is not necessary that high pressure introduction grooves 61, 62, 64 and 65 are selectively formed on pressure plate 23 and mounting raised portion 13, and cam ring 16. High pressure introduction grooves 61, 62, 64 and 65 may be formed on the both confronting surfaces.

(1) A variable displacement vane pump according to the present invention includes: a pump housing including a first housing (11) which has a pump element receiving portion (10) which is located radially inside the first housing (11), and which has an opening opened in a first axial end surface of the first housing (11), a second housing (12) contacting the first housing (11), and closing the opening of the first axial end surface of the first housing (11), and a joining member joining an outer circumference portion of the first housing (11) and an outer circumference portion of the second housing (12); a drive shaft (14) rotatably supported within the pump housing; an adapter ring (15) which is a substantially circular shape, and which is mounted in an inner circumference surface (10*b*) of the pump element receiving portion (10) of the first housing (11); a cam ring (16) disposed radially inside the adapter ring (15), and arranged to be moved to be eccentric from a center of the drive shaft (14); a rotor (21) which is received radially inside the cam ring (16), which is driven by the drive shaft (14), and which includes a plurality of slits (21*a*) formed in an outer circumference portion of the rotor (21); a plurality of vanes (22) each of which is received in one of the slits (21*a*), each of which is arranged to be moved into and out of the one of the slits (21*a*), and which separate a plurality of pump chambers (20) radially between the cam ring (16) and the rotor (21); a pressure plate (23) disposed within the pump element receiving portion (10) between an inner side surface (10*b*) of the pump element receiving portion (10) and the adapter ring (15), and urged toward the adapter ring (15) by a discharge pressure acted to a surface (23*b*) of the pressure plate (23) which is opposite to a confronting surface (23*a*) confronting the adapter ring (15); a suction port (25, 35) formed in at least one of the second housing (12) and the pressure plate (23), and opened in a region (I) in which an internal volume of each of the pump chambers (20) is increased in accordance with the rotation of the rotor (21); a suction passage formed within the pump housing (11,12), and arranged to introduce the hydraulic fluid through the suction port to the pump chambers (20) positioned in the region (I) in which the internal volume of each of the pump chambers (20) is increased; a discharge port (30,39) formed in at least one of the second housing (12) and the pressure plate (23), and opened in a region (O) in which the internal volume of each of the pump chambers (20) is decreased in accordance with the rotation of the rotor (21); a discharge passage formed within the pump housing (11,12), and arranged to introduce, through the discharge port (30,39) to the outside, the hydraulic fluid discharged from the pump chambers (20) positioned in the region (O) in which the internal volume of each of the pump chambers (20) is decreased; a first fluid pressure chamber (P1) separated radially between the adapter ring (15) and the cam ring (16), on a side on which an internal volume is decreased when the cam ring (16) is moved in a direction in which an eccentric amount of the cam ring (16) is increased; a second fluid pressure chamber (P2) separated radially between the adapter ring (15) and the cam ring (16), on a side on which an internal volume is increased when the cam ring (16) is moved in a direction in which the eccentric amount of the cam ring (16) is increased; a control section (40) configured to control an internal pressure of the first fluid pressure chamber (P1) or the second fluid pressure chamber (P2), and thereby to control the eccentric amount of the cam ring (16); a plate side high pressure introduction groove (61,62) formed in the confronting surface (23*a*) of the pressure plate (23) which confronts the cam ring (16), or in a confronting surface (16*b*) of the cam ring (16) which confronts the pressure plate (23), formed so that an entire of the plate side high pressure introduction groove (61,62) is positioned within a radial region (W0) of a radial width (W0) of the cam ring (16), and that a part of the plate side high pressure introduction groove (61,62) is positioned in a circumferential region (CL1,CL2) between the suction port (35) and the discharge port (30), and arranged to receive a hydraulic pressure larger than a suction pressure within the suction port (35); and a housing side high pressure introduction groove (64,65) formed in a confronting surface (13) of the second housing (12) which confronts the cam ring (16), or in a confronting surface (16*c*) of the cam ring (16) which confronts the second housing (13), formed so that an entire of the housing side high pressure introduction groove (64,65) is positioned within the radial region of the radial width (W0) of the cam ring (16), that a radial center (M4,M5) of the radial width (W4,W5) of the housing side high pressure introduction groove (64,65) is positioned radially outside the radial center (M1,M2) of the radial width (W1,W2) of the plate side high pressure introduction groove (61,62), and that a part of the housing side high pressure introduction groove (64,65) is overlapped with the plate side high pressure introduction groove (61,62) in the circumferential direction, and arranged to receive the hydraulic pressure larger than the suction pressure within the suction port (25,35).

Accordingly, it is possible to ensure larger seal width on the side on which the clearance is relatively enlarged on the inside and the outside of the radial direction when the pressure plate and the second housing are deformed in accordance with the pressure increase within the pump, and thereby to suppress the leakage of the hydraulic fluid from the high pressure introduction groove.

(a) The plate side high pressure introduction groove (61, 62) is connected with the discharge port (30,39); and the housing side high pressure introduction groove (64,65) is connected with the discharge port (30,39).

Accordingly, it is possible to introduce the discharge pressure in the discharge port, to the both of the high pressure introduction grooves, and to sufficiently lubricate at the movement of the cam ring.

(b) One of the plate side high pressure introduction groove (61,62) and the housing side high pressure introduction groove (64,65) includes a first circumferential end connected with the discharge port (30,39), and a second circumferential end located at a circumferential position nearer to the discharge port (30,39) than to the suction port (25,35).

In this way, the end (second circumferential end) of the high pressure introduction groove is positioned at a circumferential position short of the suction port. That is, the high pressure introduction groove is formed so as not to be overlapped with the suction port in the radial direction. Accordingly, it is possible to suppress the leakage of the hydraulic fluid from the high pressure introduction groove to the suction port while the discharge pressure is introduced to the high pressure introduction groove.

(c) One of the plate side high pressure introduction groove (61,62) and the housing side high pressure introduction groove (64,65) is formed to vary, in the circumferential direction, a radial distance (L1,L1') between a center (M1,M1',M2, M2') of a radial width (W1,W2,W1',W2') of the one of the plate side high pressure introduction groove (61,62) and the housing side high pressure introduction groove (64,65), and a rotational center (Q) of the rotation of the rotor (21).

Accordingly, it is possible to set a seal width in accordance with a leak property (characteristic) at each circumferential position, and to effectively suppress the leakage of the hydraulic fluid.

(d) One of the plate side high pressure introduction groove (61,62) and the housing side high pressure introduction groove (64,65) is formed so that in the circumferential direction, a radial distance (L1') on the suction port side (61*c*) between the center (M1') of the radial width (W1') of the one of the plate side high pressure introduction groove (61,62) and the housing side pressure introduction groove (64,65), and the rotational center (Q) of the rotor (21) is larger than a radial distance (L1') on the discharge port side (61*b*) between the center (M1) of the radial width (W1) of the one of the plate side high pressure introduction groove (61,62) and the housing side high pressure introduction groove (64,65), and the rotational center (Q) of the rotor (21).

Accordingly, it is possible to ensure the large separating amount (distance) with respect to the suction port, on the suction port side which tends to cause the leakage of the hydraulic fluid for the large pressure difference. Therefore, it is possible to effectively suppress the leakage of the hydraulic fluid.

(e) One of the plate side high pressure introduction groove (61,62) and the housing side high pressure introduction groove (64,65) is arranged to receive the hydraulic pressure smaller than the discharge pressure in the discharge port (30,39).

Accordingly, it is possible to attain the sufficient lubricating function at the movement of the cam ring, and to suppress the leakage of the hydraulic fluid from the high pressure introduction groove.

(f) The control section (40) is configured to control the internal pressure of the first fluid pressure chamber (P1); one of the plate side high pressure introduction groove (61,62) and the housing side high pressure introduction groove (64, 65) is connected with the first fluid pressure chamber (P1); and the one of the plate side high pressure introduction groove (61,62) and the housing side high pressure introduction groove (64,65) is arranged to receive the hydraulic pressure in the first fluid pressure chamber (P1).

That is, the internal pressure of the first fluid pressure chamber is higher than the suction pressure controlled by the control section, and lower than the discharge pressure. The internal pressure of the first fluid pressure chamber is for controlling the eccentric amount (eccentricity) of the cam ring. Accordingly, it is unnecessary to produce a new (special) pressure by using the exiting hydraulic pressure. Therefore, it is possible to attain the preferable lubricating function at the movement of the cam ring without complicating the structure of the pump.

(g) One of the plate side high pressure introduction groove (61,62) and the housing side high pressure introduction groove (64,65) has a region in which a cross section has a substantially constant radial width in a groove depth direction.

In this way, the plate side high pressure introduction groove or the housing side high pressure introduction groove has the region in which the cross section has the substantially constant radial width in the groove depth direction. With this, it is possible to largely secure the flow cross section, and thereby to improve the lubricating function at the movement of the cam ring.

(2) A variable displacement vane pump according to the present invention includes a first fluid pressure chamber side high pressure introduction groove (61) formed in the confronting surface (23*a*) of the pressure plate (23) which confronts the cam ring (16), or in a confronting surface (16*b*) of the cam ring (16) which confronts the pressure plate (23), positioned so that an entire of the first fluid pressure chamber side high pressure introduction groove (61) is positioned within a radial region of a radial width (W0) of the cam ring (16), and that a part of the first fluid pressure chamber side high pressure introduction groove (61) is positioned in a circumferential region (CL1) between a rotational terminal end of the suction port (35) which is a terminal end of the suction port (35) in a rotational direction of the rotor (21), and a rotational start end of the discharge port (30) which is a start end of the discharge port (39) in the rotational direction of the rotor (21), and arranged to receive a hydraulic pressure larger than the suction pressure within the suction port (35); and a second fluid pressure chamber side high pressure introduction groove (62) formed in the confronting surface (23*a*) of the pressure plate (23) which confronts the cam ring (16), or in the confronting surface (16*b*) of the cam ring (16) which confronts the pressure plate (23), formed so that an entire of the second fluid pressure chamber side high pressure introduction groove (62,65) is positioned within the radial region of the radial width (W0) of the cam ring (16), that a radial center (M2) of a radial width (W2) of the second fluid pressure chamber side high pressure introduction groove (62) is positioned at a position apart from a center of the cam ring (16) with respect to a radial center (M1) of the radial width (W1) of the first fluid pressure chamber side high pressure introduction groove (61,64) in a maximum eccentric state of the cam ring (16), and that a part of the second fluid pressure chamber side high pressure introduction groove (62) is positioned in a circumferential region (CL2) between a rotational terminal end of the discharge port (30) which is a terminal end of the discharge port (30) in the rotational direction of the rotor (21) and a rotational start end of the suction port (35) which is a start end of the suction port (35) in the rotational direction of the rotor (21), and arranged to receive a hydraulic pressure larger than the suction pressure within the suction port (35).

The first fluid pressure chamber side high pressure introduction groove is offset to the inner circumference side of the cam ring relative to the second fluid pressure chamber side high pressure introduction groove. With this, it is possible to largely ensure the seal width between the cam ring and the pressure plate radially outside the first fluid pressure chamber side high pressure introduction groove, relative to the second fluid pressure chamber side high pressure introduction groove. Therefore, it is possible to suppress the leakage of the hydraulic fluid from the high pressure introduction groove to the radially outer side in accordance with the pressure increase within the pump.

Moreover, the seal width radially outside the first fluid pressure chamber side high pressure introduction groove is enlarged by the offset arrangement. With this, it is possible to suppress the protrusion of the first fluid pressure chamber side high pressure introduction groove to the outer circumference side of the cam ring in the minimum eccentric state of the cam ring when the first fluid pressure chamber side high pressure introduction groove is formed in the pressure plate. On the other hand, the second fluid pressure chamber side high pressure introduction groove is offset from the first fluid pressure chamber side high pressure introduction groove in the radially outward direction. With this, it is possible to suppress the protrusion of the second fluid pressure chamber side high pressure introduction groove in the radially inward direction of the cam ring in the minimum eccentric state of the cam ring when the second fluid pressure chamber side high pressure introduction groove is formed in the pressure plate.

(h) The second fluid pressure chamber side high pressure introduction groove (62) is positioned at a position radially outside an inner circumference edge of the cam ring (16) in a minimum eccentric state of the cam ring (16).

Accordingly, the second fluid pressure chamber side high pressure introduction groove is not deviated from the cam ring in the minimum eccentric state of the cam ring. Therefore, it is possible to effectively suppress the leakage of the hydraulic pressure from the high pressure introduction groove.

(i) The first fluid pressure chamber side high pressure introduction groove (61) is connected with the discharge port (30); and the second fluid pressure chamber side high pressure introduction groove (62,65) is connected with the discharge port (30).

Accordingly, it is possible to introduce the discharge pressure in the discharge port to both of the high pressure introduction grooves, and thereby to sufficiently lubricate at the movement of the cam ring.

(j) One of the first fluid pressure chamber side high pressure introduction groove (61) and the second fluid pressure chamber side high pressure introduction groove (62) includes a first circumferential end connected with the discharge port, and a second circumferential end located at a circumferential position positioned nearer to the discharge port (39) than to the suction port (35).

In this way, the end (the second circumferential end) of the high pressure introduction groove is positioned at a circumferential position short of the suction port. That is, the high pressure introduction groove is not overlapped with the suction port in the radial direction. Accordingly, it is possible to suppress the leakage of the hydraulic fluid from the high pressure introduction groove to the suction port while the discharge pressure is introduced to the high pressure introduction groove.

(k) One of the first fluid pressure chamber side high pressure introduction groove (61) and the second fluid pressure chamber side high pressure introduction groove (62) has a region of a cross section which has a substantially constant radial width in a groove depth direction.

In this way, the first fluid pressure chamber side high pressure introduction groove and the second fluid pressure chamber side high pressure introduction groove has the region in which the cross section has the substantially constant groove width. Accordingly, it is possible to ensure larger flow passage cross section, and thereby to improve the lubricating function at the movement of the cam ring.

(l) One of the first fluid pressure chamber side high pressure introduction groove (61) and the second fluid pressure chamber side high pressure introduction groove (62) is arranged to receive the hydraulic pressure smaller than the discharge pressure in the discharge port (30).

Accordingly, it is possible to attain the sufficient lubricating function at the movement of the cam ring, and to suppress the leakage of the hydraulic fluid from the high pressure introduction groove.

(3) A variable displacement vane pump according to the present invention includes a first fluid pressure chamber side high pressure introduction groove (64) formed in a confronting surface (13) of the second housing (12) which confronts the cam ring (16), or in a confronting surface (16*c*) of the cam ring (16) which confronts the second housing (12), formed so that an entire of the first fluid pressure chamber side high pressure introduction groove (64) is positioned within a radial region of a radial width (W0) of the cam ring (16), and that a part of the first fluid pressure chamber side high pressure introduction groove (64) is positioned in a circumferential region (CL1) between a rotational terminal end of the suction port (25) which is a terminal end of the suction port (25) in the rotational direction of the rotor (21), and a rotational start end of the discharge port (39) which is a start end of the discharge port (39) in the rotational direction of the rotor (21), and arranged to receive a hydraulic pressure larger than the suction pressure within the suction port (25); and a second fluid pressure chamber side high pressure introduction groove (65) formed in the confronting surface (13) of the second housing (12) which confronts the cam ring (16), or in the confronting surface (16*c*) of the cam ring (16) which confronts the second housing (12), formed so that an entire of the second fluid pressure chamber side high pressure introduction groove (65) is positioned within the radial region of the radial width (W0) of the cam ring 16), that a radial center (M5) of the second fluid pressure chamber side high pressure introduction groove (65) is positioned at a position apart from a center of the cam ring (16) with respect to a radial center (M4) of the radial width (W4) of the first fluid pressure chamber side high pressure introduction groove (64) in a maximum eccentric state of the cam ring (16), and that a part of the second fluid pressure chamber side high pressure introduction groove (65) is positioned in a circumferential region (CL2) between a rotational terminal end of the discharge port (39) which is a terminal end of the discharge port (39) in the rotational direction of the rotor (21) and a rotational start end of the suction port (25) in the rotational direction of the rotor (21), and arranged to receive a hydraulic pressure larger than the suction pressure within the suction port (25).

The second fluid pressure chamber side high pressure introduction groove is offset to the radially outer side relative to the first fluid pressure chamber side high pressure introduction groove. With this, it is possible to ensure a relatively large seal width between the cam ring and the pressure plate radially inside the second fluid pressure chamber side high pressure introduction groove, relative to the first fluid pressure chamber side high pressure introduction groove. Accordingly, it is possible to suppress the leakage of the hydraulic fluid from the second fluid pressure chamber side high pressure introduction groove to the radially inward portion in accordance with the pressure increase within the pump.

Moreover, the seal width radially inside the second fluid pressure chamber side high pressure introduction groove is enlarged by the offset arrangement. With this, it is possible to suppress the protrusion of the second fluid pressure chamber side high pressure introduction groove on the radially inward side in the minimum eccentric state of the cam ring when the second fluid pressure chamber side high pressure introduction groove is formed in the second housing. On the other hand, the first fluid pressure chamber side high pressure introduction groove is offset relative to the second fluid pressure chamber side high pressure introduction groove in the radially outward direction. With this, it is possible to suppress the protrusion of the first fluid pressure chamber side high pressure introduction groove in the minimum eccentric state of the cam ring when the first fluid pressure chamber side high pressure introduction groove is formed in the second housing.

(m) The second fluid pressure chamber side high pressure introduction groove is positioned at a radial position radially outside an inner circumference edge of the cam ring in a minimum eccentric state of the cam ring.

Accordingly, the second fluid pressure chamber side high pressure introduction groove is not deviated from the cam ring in the minimum eccentric state of the cam ring. Therefore, it is possible to effectively suppress the leakage of the hydraulic fluid from the high pressure introduction groove.

(n) The first fluid pressure chamber side high pressure introduction groove (64) is connected with the discharge port (39); and the second fluid pressure chamber side high pressure introduction groove (65) is connected with the discharge port (39).

Accordingly, it is possible to introduce the discharge pressure in the discharge port to the both of the high pressure introduction grooves, and to sufficiently lubricate at the movement of the cam ring.

(o) One of the first fluid pressure chamber side high pressure introduction groove (64) and the second high pressure chamber side high pressure introduction groove (65) includes a first circumferential end connected with the discharge port (39), and a second circumferential end positioned at a circumferential position nearer to the discharge port (39) than to the suction port (35).

In this way, the end (the second circumferential end) of the high pressure introduction groove is positioned at a circumferential position short of the suction opening. That is, the end (the second circumferential end) of the high pressure introduction groove is positioned at a circumferential position nearer to the discharge port than to the suction port. That is, the high pressure introduction groove is not overlapped with the suction port in the radial direction. Accordingly, it is possible to suppress the leakage of the hydraulic fluid from the high pressure introduction groove to the suction port while the discharge pressure is introduced to the high pressure introduction groove.

(p) One of the first fluid pressure chamber side high pressure introduction groove (64) and the second fluid pressure chamber side high pressure introduction groove (65) has a region of a cross section which has a substantially constant radial width in a groove width direction.

In this way, the one of the first fluid pressure chamber side high pressure introduction groove and the second fluid pressure chamber side high pressure introduction groove has the region in which the cross section has the substantially constant radial width. Accordingly, it is possible to ensure the larger cross section of the flow passage, and thereby to improve the lubricating function at the movement of the cam ring.

(q) One of the first fluid pressure chamber side high pressure introduction groove and the second fluid pressure chamber side high pressure introduction groove is arranged to receive a hydraulic pressure smaller than the discharge pressure in the discharge port.

Accordingly, it is possible to attain the sufficient lubricating function at the movement of the cam ring, and to suppress the leakage of the hydraulic fluid from the high pressure introduction groove.

The entire contents of Japanese Patent Application No. 2009-287885 filed Dec. 18, 2009 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A variable displacement vane pump comprising:

a pump housing including a first housing which has a pump element receiving portion which is located radially inside the first housing, and which has an opening opened in a first axial end surface of the first housing, a second housing contacting the first housing, and closing the opening of the first axial end surface of the first housing, and a joining member joining an outer circumference portion of the first housing and an outer circumference portion of the second housing;

a drive shaft rotatably supported within the pump housing;

an adapter ring which is a substantially circular shape, and which is mounted in an inner circumference surface of the pump element receiving portion of the first housing;

a cam ring disposed radially inside the adapter ring, and arranged to be moved to be eccentric from a center of the drive shaft;

a rotor which is received radially inside the cam ring, which is driven by the drive shaft, and which includes a plurality of slits formed in an outer circumference portion of the rotor;

a plurality of vanes each of which is received in one of the slits, each of which is arranged to be moved into and out of the one of the slits, and which separate a plurality of pump chambers radially between the cam ring and the rotor;

a pressure plate disposed within the pump element receiving portion between an inner side surface of the pump element receiving portion and the adapter ring, and urged toward the adapter ring by a discharge pressure acted on a surface of the pressure plate which is opposite to a confronting surface of the pressure plate confronting the adapter ring;

a suction port formed in at least one of the second housing and the pressure plate, and opened in a region in which an internal volume of each of the pump chambers is increased in accordance with a rotation of the rotor;

a suction passage formed within the pump housing, and arranged to introduce hydraulic fluid through the suction port to the pump chambers positioned in the region in which the internal volume of each of the pump chambers is increased;

a discharge port formed in at least one of the second housing and the pressure plate, and opened in a region in which the internal volume of each of the pump chambers is decreased in accordance with the rotation of the rotor;

a discharge passage formed within the pump housing, and arranged to introduce, through the discharge port to outside, the hydraulic fluid discharged from the pump chambers positioned in the region in which the internal volume of each of the pump chambers is decreased;

a first fluid pressure chamber separated radially between the adapter ring and the cam ring, on a side on which an internal volume is decreased when the cam ring is moved in a direction in which an eccentric amount of the cam ring is increased;

a second fluid pressure chamber separated radially between the adapter ring and the cam ring, on a side on which an internal volume is increased when the cam ring is moved in a direction in which the eccentric amount of the cam ring is increased;

a control section configured to control an internal pressure of the first fluid pressure chamber or the second fluid pressure chamber, and thereby to control the eccentric amount of the cam ring;

a plate side high pressure introduction groove formed in the confronting surface of the pressure plate which also confronts the cam ring, or in a confronting surface of the cam ring which confronts the pressure plate, formed such that an entirety of the plate side high pressure introduction groove is positioned within a radial region of a radial width of the cam ring, and such that a part of the plate side high pressure introduction groove is positioned in a circumferential region between the suction port and the discharge port, and arranged to receive a hydraulic pressure larger than a suction pressure within the suction port; and a housing side high pressure introduction groove formed in a confronting surface of the second housing which confronts the cam ring, or in a confronting surface of the cam ring which confronts the second housing, formed such that an entirety of the housing side high pressure introduction groove is positioned within the radial region of the radial width of the cam ring, such that a radial center of a radial width of the housing side high pressure introduction groove is positioned radially outside a radial center of a radial width of the plate side high pressure introduction groove, and such that a part of the housing side high pressure introduction groove is overlapped with the plate side high pressure introduction groove in a circumferential direction, and arranged to receive the hydraulic pressure larger than the suction pressure within the suction port.

2. The variable displacement vane pump defined in claim 1, wherein the plate side high pressure introduction groove is connected with the discharge port; and the housing side high pressure introduction groove is connected with the discharge port.

3. The variable displacement vane pump defined in claim 2, wherein one of the plate side high pressure introduction groove and the housing side high pressure introduction groove includes a first circumferential end connected with the discharge port, and a second circumferential end located at a circumferential position nearer to the discharge port than to the suction port.

4. The variable displacement vane pump defined in claim 1, wherein one of the plate side high pressure introduction groove and the housing side high pressure introduction groove is formed to vary, in the circumferential direction, a radial distance between a center of a radial width of the one of the plate side high pressure introduction groove and the housing side high pressure introduction groove, and a rotational center of the rotation of the rotor.

5. The variable displacement vane pump defined in claim 4, wherein one of the plate side high pressure introduction groove and the housing side high pressure introduction groove is formed so that in the circumferential direction, a radial distance on a suction port side between the center of the radial width of the one of the plate side high pressure introduction groove and the housing side pressure introduction groove, and the rotational center of the rotor is larger than a radial distance on a discharge port side between the center of the radial width of the one of the plate side high pressure introduction groove and the housing side high pressure introduction groove, and the rotational center of the rotor.

6. The variable displacement vane pump defined in claim 1, wherein one of the plate side high pressure introduction groove and the housing side high pressure introduction groove is arranged to receive a hydraulic pressure smaller than the discharge pressure in the discharge port.

7. The variable displacement vane pump defined in claim 6, wherein:

the control section is configured to control the internal pressure of the first fluid pressure chamber;

one of the plate side high pressure introduction groove and the housing side high pressure introduction groove is connected with the first fluid pressure chamber; and the one of the plate side high pressure introduction groove and the housing side high pressure introduction groove is arranged to receive hydraulic pressure in the first fluid pressure chamber.

8. The variable displacement vane pump defined in claim 1, wherein one of the plate side high pressure introduction groove and the housing side high pressure introduction groove has a region in which a cross section has a substantially constant radial width in a groove depth direction.

9. A variable displacement vane pump comprising:

a pump housing including a first housing which has a pump element receiving portion which is located radially inside the first housing, and which has an opening opened in a first axial end surface of the first housing, a second housing contacting the first housing, and closing the opening of the first axial end surface of the first housing, and a joining member joining an outer circumference portion of the first housing and an outer circumference portion of the second housing;

a drive shaft rotatably supported within the pump housing;

an adapter ring which is a substantially circular shape, and which is mounted in an inner circumference surface of the pump element receiving portion of the first housing;

a cam ring disposed radially inside the adapter ring, and arranged to be moved to be eccentric from a center of the drive shaft;

a rotor which is received radially inside the cam ring, which is driven by the drive shaft, and which includes a plurality of slits formed in an outer circumference portion of the rotor;

a plurality of vanes each of which is received in one of the slits, each of which is arranged to be moved into and out of the one of the slits, and which separate a plurality of pump chambers radially between the cam ring and the rotor;

a pressure plate disposed within the pump element receiving portion between an inner side surface of the pump element receiving portion and the adapter ring, and urged toward the adapter ring by a discharge pressure acted on a surface of the pressure plate which is opposite to a confronting surface of the pressure plate confronting the adapter ring;

a suction port formed in at least one of the second housing and the pressure plate, and opened in a region in which an internal volume of each of the pump chambers is increased in accordance with a rotation of the rotor;

a suction passage formed within the pump housing, and arranged to introduce hydraulic fluid through the suction port to the pump chambers positioned in the region in which the internal volume of each of the pump chambers is increased;

a discharge port formed in at least one of the second housing and the pressure plate, and opened in a region in which the internal volume of each of the pump chambers is decreased in accordance with the rotation of the rotor;

a discharge passage formed within the pump housing, and arranged to introduce, through the discharge port to outside, the hydraulic fluid discharged from the pump chambers positioned in the region in which the internal volume of each of the pump chambers is decreased;

a first fluid pressure chamber separated radially between the adapter ring and the cam ring, on a side on which an internal volume is decreased when the cam ring is moved in a direction in which an eccentric amount of the cam ring is increased;

a second fluid pressure chamber separated radially between the adapter ring and the cam ring, on a side on which an internal volume is increased when the cam ring is moved in a direction in which the eccentric amount of the cam ring is increased;

a control section configured to control an internal pressure of the first fluid pressure chamber or the second fluid pressure chamber, and thereby to control the eccentric amount of the cam ring;

a first fluid pressure chamber side high pressure introduction groove formed in the confronting surface of the pressure plate which also confronts the cam ring, or in a confronting surface of the cam ring which confronts the pressure plate, positioned such that an entirety of the first fluid pressure chamber side high pressure introduction groove is positioned within a radial region of a radial width of the cam ring, and such that a part of the first fluid pressure chamber side high pressure introduction groove is positioned in a circumferential region between a rotational terminal end of the suction port which is a terminal end of the suction port in a rotational direction of the rotor, and a rotational start end of the discharge port which is a start end of the discharge port in the rotational direction of the rotor, and arranged to receive a hydraulic pressure larger than the suction pressure within the suction port; and a second fluid pressure chamber side high pressure introduction groove formed in the confronting surface of the pressure plate which confronts the cam ring, or in the confronting surface of the cam ring which confronts the pressure plate, formed such that an entirety of the second fluid pressure chamber side high pressure introduction groove is positioned within the radial region of the radial width of the cam ring, such that a radial center of a radial width of the second fluid pressure chamber side high pressure introduction groove is positioned at a position apart from a center of the cam ring with respect to a radial center of a radial width of the first fluid pressure chamber side high pressure introduction groove in a maximum eccentric state of the cam ring, and such that a part of the second fluid pressure chamber side high pressure introduction groove is positioned in a circumferential region between a rotational terminal end of the discharge port which is a terminal end of the discharge port in the rotational direction of the rotor and a rotational start end of the suction port which is a start end of the suction port in the rotational direction of the rotor, and arranged to receive the hydraulic pressure larger than the suction pressure within the suction port, wherein the first fluid pressure chamber side high pressure introduction groove is connected with the discharge port, wherein the second fluid pressure chamber side high pressure introduction groove is connected with the discharge port, and wherein one of the first fluid pressure chamber side high pressure introduction groove and the second fluid pressure chamber side high pressure introduction groove includes a first circumferential end connected with the discharge port, and a second circumferential end located at a circumferential position positioned nearer to the discharge port than to the suction port.

10. The variable displacement vane pump defined in claim 9, wherein the second fluid pressure chamber side high pressure introduction groove is positioned at a position radially outside an inner circumference edge of the cam ring in a minimum eccentric state of the cam ring.

11. The variable displacement vane pump defined in claim 9, wherein one of the first fluid pressure chamber side high pressure introduction groove and the second fluid pressure chamber side high pressure introduction groove has a region of a cross section which has a substantially constant radial width in a groove depth direction.

12. The variable displacement vane pump defined in claim 9, wherein one of the first fluid pressure chamber side high pressure introduction groove and the second fluid pressure chamber side high pressure introduction groove is arranged to receive a hydraulic pressure smaller than the discharge pressure in the discharge port.

13. A variable displacement vane pump comprising:

a pump housing including a first housing which has a pump element receiving portion which is located radially inside the first housing, and which has an opening opened in a first axial end surface of the first housing, a second housing contacting the first housing, and closing the opening of the first axial end surface of the first housing, and a joining member joining an outer circumference portion of the first housing and an outer circumference portion of the second housing;

a drive shaft rotatably supported within the pump housing;

an adapter ring which is a substantially circular shape, and which is mounted in an inner circumference surface of the pump element receiving portion of the first housing;

a cam ring disposed radially inside the adapter ring, and arranged to be moved to be eccentric from a center of the drive shaft;

a rotor which is received radially inside the cam ring, which is driven by the drive shaft, and which includes a plurality of slits formed in an outer circumference portion of the rotor;

a plurality of vanes each of which is received in one of the slits, each of which is arranged to be moved into and out of the one of the slits, and which separate a plurality of pump chambers radially between the cam ring and the rotor;

a pressure plate disposed within the pump element receiving portion between an inner side surface of the pump element receiving portion and the adapter ring, and urged toward the adapter ring by a discharge pressure acted on a surface of the pressure plate which is opposite to a confronting surface of the pressure plate confronting the adapter ring;

a suction port formed in at least one of the second housing and the pressure plate, and opened in a region in which an internal volume of each of the pump chambers is increased in accordance with a rotation of the rotor;

a suction passage formed within the pump housing, and arranged to introduce hydraulic fluid through the suction port to the pump chambers positioned in the region in which the internal volume of each of the pump chambers is increased;

a discharge port formed in at least one of the second housing and the pressure plate, and opened in a region in which the internal volume of each of the pump chambers is decreased in accordance with the rotation of the rotor;

a discharge passage formed within the pump housing, and arranged to introduce, through the discharge port to outside, the hydraulic fluid discharged from the pump so chambers positioned in the region in which the internal volume of each of the pump chambers is decreased;

a first fluid pressure chamber separated radially between the adapter ring and the cam ring, on a side on which an internal volume is decreased when the cam ring is moved in a direction in which an eccentric amount of the cam ring is increased;

a second fluid pressure chamber separated radially between the adapter ring and the cam ring, on a side on which an internal volume is increased when the cam ring is moved in a direction in which the eccentric amount of the cam ring is increased;

a control section configured to control an internal pressure of the first fluid pressure chamber or the second fluid pressure chamber, and thereby to control the eccentric amount of the cam ring;

a first fluid pressure chamber side high pressure introduction groove formed in a confronting surface of the second housing which confronts the cam ring, or in a confronting surface of the cam ring which confronts the second housing, formed so that an entirety of the first fluid pressure chamber side high pressure introduction groove is positioned within a radial region of a radial width of the cam ring, and such that a part of the first fluid pressure chamber side high pressure introduction groove is positioned in a circumferential region between a rotational terminal end of the suction port which is a terminal end of the suction port in a rotational direction of the rotor, and a rotational start end of the discharge port which is a start end of the discharge port in the rotational direction of the rotor, and arranged to receive a hydraulic pressure larger than the suction pressure within the suction port; and a second fluid pressure chamber side high pressure introduction groove formed in the confronting surface of the second housing which confronts the cam ring, or in the confronting surface of the cam ring which confronts the second housing, formed so that an entirety of the second fluid pressure chamber side high pressure introduction groove is positioned within the radial region of the radial width of the cam ring, such that a radial center of the second fluid pressure chamber side high pressure introduction groove is positioned at a position apart from a center of the cam ring with respect to a radial center of a radial width of the first fluid pressure chamber side high pressure introduction groove in a maximum eccentric state of the cam ring, and such that a part of the second fluid pressure chamber side high pressure introduction groove is positioned in a circumferential region between a rotational terminal end of the discharge port which is a terminal end of the discharge port in the rotational direction of the rotor and a rotational start end of the suction port in the rotational direction of the rotor, and arranged to receive the hydraulic pressure larger than the suction pressure within the suction port.

14. The variable displacement vane pump defined in claim 13, wherein the second fluid pressure chamber side high pressure introduction groove is positioned at a radial position radially outside an inner circumference edge of the cam ring in a minimum eccentric state of the cam ring.

15. The variable displacement vane pump defined in claim 13, wherein the first fluid pressure chamber side high pressure introduction groove is connected with the discharge port; and the second fluid pressure chamber side high pressure introduction groove is connected with the discharge port.

16. The variable displacement vane pump defined in claim 15, wherein one of the first fluid pressure chamber side high pressure introduction groove and the second high pressure chamber side high pressure introduction groove includes a first circumferential end connected with the discharge port, and a second circumferential end positioned at a circumferential position nearer to the discharge port than to the suction port.

17. The variable displacement vane pump defined in claim 13, wherein one of the first fluid pressure chamber side high pressure introduction groove and the second fluid pressure chamber side high pressure introduction groove has a region of a cross section which has a substantially constant radial width in a groove width direction.

18. The variable displacement vane pump defined in claim 13, wherein one of the first fluid pressure chamber side high pressure introduction groove and the second fluid pressure chamber side high pressure introduction groove is arranged to receive a hydraulic pressure smaller than the discharge pressure in the discharge port.

* * * * *